US006522760B2

(12) United States Patent
Azima et al.

(10) Patent No.: US 6,522,760 B2
(45) **Date of Patent: *Feb. 18, 2003**

(54) ACTIVE ACOUSTIC DEVICES

(75) Inventors: Farad Azima, London (GB); Henry Azima, Cambridge (GB); Martin Colloms, London (GB); Graham Bank, Huntingdon (GB); Nicholas Patrick Roland Hill, Cambridge (GB)

(73) Assignee: New Transducers Limited, London (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/233,037

(22) Filed: Jan. 20, 1999

(65) Prior Publication Data

US 2003/0007653 A1 Jan. 9, 2003

Related U.S. Application Data

(63) Continuation-in-part of application No. 08/707,012, filed on Sep. 3, 1996, now Pat. No. 6,332,029.

(30) Foreign Application Priority Data

| | | |
|---|---|---|
| Jan. 20, 1998 | (GB) | 9801054 |
| Jan. 20, 1998 | (GB) | 9801057 |
| May 23, 1998 | (GB) | 9811100 |
| Jun. 20, 1998 | (GB) | 9813293 |

(51) Int. Cl.[7] ..... H04R 25/00

(52) U.S. Cl. ..... 381/152; 381/423; 381/426; 381/431

(58) Field of Search ..... 381/152, 162, 381/163, 386, 388, 395, 398, 423, 431, 190, 191; 181/171, 172, 173

(56) References Cited

U.S. PATENT DOCUMENTS

| | | | | |
|---|---|---|---|---|
| 1,500,331 A | | 7/1924 | Marriott | |
| 3,247,925 A | | 4/1966 | Warnaka | 181/31 |
| 3,347,335 A | | 10/1967 | Watters et al. | 181/0.5 |
| 3,509,290 A | * | 4/1970 | Mochida | |
| 6,058,196 A | * | 1/2000 | Heron | |
| 6,031,926 A | * | 2/2000 | Azima | |

FOREIGN PATENT DOCUMENTS

| | | |
|---|---|---|
| WO | WO 92/03024 | 2/1992 |
| WO | WO 97/09842 | 3/1997 |

* cited by examiner

*Primary Examiner*—Curtis Kuntz
*Assistant Examiner*—P. Dabney
(74) *Attorney, Agent, or Firm*—Foley & Lardner

(57) ABSTRACT

Active acoustic device comprises a panel member (11) having distribution of resonant modes of bending wave action determining acoustic performance in conjunction with a transducer (31–34). The transducer (31–34) is coupled to the panel member (11) at a marginal position. The arrangement is such as to result in acoustically acceptable action dependent on said distribution of active said resonant modes. Methods of selecting the transducer location, or improvement by location of localized marginal clamping, rely on assessing best or better operative interaction of said transducer (31–34) and the panel members (11) according to parameters of acoustic output for the device as an acoustic radiator.

27 Claims, 40 Drawing Sheets

200Hz-10kHz

200Hz-4kHZ

200Hz-4kHz

200Hz-4kHz

300Hz-3kHz

300Hz-3kHz

300Hz-3kHz

200Hz-10kHz

200Hz-10kHz

200Hz-10kHz

200Hz-10kHz

300Hz-3kHz

300Hz-3kHz

300Hz-3kHz

300Hz-3kHz

300Hz-3kHz

ACTIVE ACOUSTIC DEVICES

This application is a continuation-in-part of application Ser. No. 08/707,012, filed Sep. 3, 1996 now U.S. Pat. No. 6,332,029.

DESCRIPTION

Field of the Invention

This invention relates to active acoustic devices and more particularly to panel members for which acoustic action or performance relies on beneficial distribution of resonant modes of bending wave action in such a panel member and related surface vibration; and to methods of making or improving such active acoustic devices.

It is convenient herein to use the term "distributed mode" for such acoustic devices, including acoustic radiators or loudspeakers; and for the term "panel-form" to be taken as inferring such distributed mode action in a panel member unless the context does not permit.

In or as panel-form loudspeakers, such panel members operate as distributed mode acoustic radiators relying on bending wave action induced by input means applying mechanical action to the panel member; and resulting excitation of resonant modes of bending wave action causing surface vibration for acoustic output by coupling to ambient fluid, typically air. Revelatory teaching regarding such acoustic radiators (amongst a wider class of active and passive distributed mode acoustic devices) is given in our patent application Ser. No. 08/707,012; and various of our later patent applications concern useful additions and developments.

BACKGROUND TO THE INVENTION

Hitherto, transducer locations have been considered as viably and optimally effective at locations in-board of the panel member to a substantial extent towards but offset from its centre, at least for panels that are substantially isotropic as to bending stiffness and exhibit effectively substantially constant axial anisotropy of bending stiffness(es). Aforementioned patent application Ser. No. 08/707,012 gives specific guidance in terms of optimal proportionate co-ordinates for such in-board transducer locations, including alternatives; and preference for different particular co-ordinate combinations when using two or more transducers.

Various advantageous applications peculiar to the panel-form of acoustic devices have been foreshadowed, including carrying acoustically non-intrusive surfacing sheets or layers. For example, physically merging or incorporating into trim or cladding is feasible, including as visually virtually indistinguishable. Also, functional combination is feasible with other purposes, such as display, including pictures, posters, write-on/erase boards, projection screens, etc. The capability effectively to hide in-board transducers from view is enough for many applications. However, there are potential practical applications where it could be useful to leave larger, particularly central, panel regions unobstructed even by hideable transducers. For example, for video or other see-through display use, pursuit of translucence, even transparency, of panel members is not worthwhile with such in-board intrusions of transducers, though a panel-form acoustic device would be highly attractive if it could afford large medial areas of unobstructed visibility.

SUMMARY OF THE INVENTION

According to one device aspect of this invention, there is provided a panel-form acoustic device comprising a distributed mode acoustic panel member with transducers located at a marginal position, the arrangement being such as to result in acoustically acceptable effective distribution and excitement of resonant mode vibration. Existence of suitable such marginal positions is established herein as locations for transducer, along with valuable teaching as to judicious selection or improvement of one or more such locations. Such judicious selection may advantageously be by or as would result from investigation of an acoustic radiator device or loudspeaker relative to satisfactorily introducing vibrational energy into the panel member, say conveniently by assessing parameters of acoustic output from the panel member concerned when excited at marginal positions or locations. At least best results also apply to microphones.

From the relevant background teaching as of the time of this invention, availability of successful such marginal locations is, to say the least, unexpected. Indeed, main closest prior art cited against patent application Ser. No. 08/707,012, is the start-point for its invention and revelatory teaching, namely WO92/03024 from which progress was made particularly in terms of departing from in-corner excitation thereof. Such progress involved appreciating that distributed resonant mode bending wave action as required for viable acoustic performance results in high vibrational activity at panel corners; as is also a factor for panel edges generally. At least intuitively, and as greatly reinforced by practical success with somewhat off-centre but very much in-board transducer locations, such high vibrational activity compounds strongly with panel margins self-evidently affording limited access, thus likely available effect upon, panel member material as a whole; this compounding combination contributing to previously perceived non-viability of edge excitation.

For application of this invention, a suitable acoustic panel member, or at least region thereof, may be transparent or translucent. Typical panel members may be generally polygonal, often substantially rectangular. Plural transducers may be at or near different edges, at least for substantially rectangular panel members. The or each transducer may be piezo-electric, electrostatic or electro-mechanical. The or each transducer may be arranged to launch compression waves into the panel edge, and/or to deflect the panel edge laterally to launch transverse bending waves along a panel edge, and/or to apply torsion across a panel corner, and/or to produce linear deflection of a local region of the panel.

Assessment of acoustic output from panel members may be relative to suitable criteria for acoustic output include as to amount of power output thus efficiency in converting input mechanical vibration (automatically also customary causative electrical drive) into acoustic output, smoothness of power output as measure of evenness of excitation of resonant mode of bending wave action, inspection of power output as to frequencies of excited resonant modes including number and distribution or spread of those frequencies, each up to all as useful indicators. Such assessments of viability of locations for transducers constitute method aspects of this invention individually and in combination.

As aid to assessment at least of smoothness of power output, it is further proposed herein to use techniques based on mean square deviation from some reference. Use of the inverse of mean square deviation has the benefit of presenting smoothness for assessment according directly to positive values and/or representations. A suitable reference can be individual to each case considered, say a median-based, such as represented graphically by a smoothed line through actual measured power output over a frequency range of interest. It is significantly helpful to mean square deviation assessment for the reference to have a be normalised standard format; and for the measured acoustic power output to be adjusted to fit that standard format. The standard format may be a graphically straight line, preferably a flat straight line thus corresponding to some particular constant reference value; further preferably the same line or value as found naturally to apply to a distributed mode panel member at higher frequencies where modes and modal action are more or most dense.

In this connection it is seen as noteworthy that whatever function is required for such normalising to a substantially constant reference is effectively also a basis for an equalisation function applicable to input signals to improve lower frequency acoustic output. It is the case that viable distributed mode panel members as such, and with preferential aspect ratios and bending stiffness(es) as in our above patent application, may naturally have acoustic power output characteristics relative to frequency that show progressive droops towards and through lower frequencies where resonant modes and modal action are less dense—but, as their frequency distribution as such is usually beneficial to acoustic action in such lower frequency range, such equalisation of input signal can be useful. This lower acoustic power output at lower frequencies is related to free edge vibration of the panel members as such, and consequential greater loss of lower frequency power, greater proportion of which tends to be poorly radiated and/or dissipated, including effectively short-circuited about free adjacent panel edges. As expected, these lower frequency power loss effects are significantly greater for panel members with transducer locations at or near their edges and/or lesser stiffnesses—compared with panel members using in-board transducer locations. However, and separately from any input signal equalisation, significant mitigation of these effects is available by mounting the panel members surrounded by baffles and/or by clamping at the edges of the panel members. Indeed, spaced localised edge clamps can have usefully selectively beneficial effects relative to frequencies with wavelengths greater than the spacing of the localised edge clamps.

Interestingly, for specific panel members of quite high stiffnesses, viable marginal transducer locations include positions having edge-wise correlation with normally in-board locations for transducers arising as preferred by application of teachings or practice such as specifically in our above patent applications. When using transducers in pairs, a first preference was found for marginal transducer locations with said correlation as corresponding to notionally encompassing greatest area. For a substantially rectangular panel member, said correlation can be by way of correspondence with orthogonal or Cartesian co-ordinates, with said first preference represented by associating transducers with diagonally opposite quadrants. However, this was in relation to a particularly high stiffness/high-Q panel member, and is not always true, even for quite (but less) stiff panels, see further below showing promising operation with association in some or adjacent quadrants. For an elliptical panel member said correlation/correspondence can be according to hyperbolic resonant mode related lines as going edge-wards through the in-board locations. Other variously less good, but feasibly viable, pairs of edge locations for transducers were found by investigation based on rotating orthogonal vectors about in-board preferential transducer locations, including close to or at corner positions of panel members. Another inventive aspect regarding corner or near-corner excitation involves suitably mass-loading or clamping substantially at a known in-board optimal or preferential drive location, where it appears that such mass-loaded optimal drive location(s) effectively behave(s) to some useful extent as "virtual" source(s) of bending wave vibrations in the member. This latter may not avoid central intrusion by the mass loading but is clearly germane to successful marginal excitation at corners.

Further investigations have been made, including of panel members having different stiffnesses, specifically again quite high but also much lower and intermediate stiffness panels, in each case of usual substantially rectangular configuration with aspect ratios and axial bending stiffnesses generally as in patent application Ser. No. 08/707,012.

For the higher stiffness panel member, assessment based on smoothness of power output for single transducer locations along longer and shorter edges were generally confirmatory of above preferential co-ordinate positions, i.e. peaking as expected for best locations for a single transducer. However, additionally, longer edges had promising spreads of smoothness measure within about 15% of peak at transducer locations between the co-ordinate positions in each half of the edge and beyond those co-ordinate positions to about one-third length from each corner; and within about 30% along to at least the quarter length positions. For the shorter edges, spreads of smoothness measure were within about 10% between the co-ordinate positions, and within about 25% at quarter length positions. The shorter edges actually showed a better power smoothness measure than the longer edges showed at quarter length positions right through to within about one-tenth length of the corners.

Investigation of combinations of two transducers has also been extended particularly for same and adjacent quadrants with one transducer, for one on each of longer and shorter edges. One transducer can be at one best position along one of the edges for a single transducer, with the other transducer varied along the other edge. For variation along the shorter edge, above preference for one of positions according to co-ordinates of in-board preferential transducer locations is confirmed by best smoothness measure at about six-tenths length. There are also near as good positions at three-quarter length and only a little less good at quarter and third length positions. Moreover, most positions other than below about one-tenth from a corner are better, similar, near as good, or not much worse, than for association with co-ordinates of preferred in-board locations in the same quadrant. For variation along the longer edge, the shorter edge transducer was located at about preferred near six-tenths position, there was then actually marked preference for combinations of transducer locations in adjacent quadrants, with best at just under one-fifth, and slightly better than the 0.42 position at the one-third length position with only a little worse at the one-tenth length position. The quarter length position is actually about the same as for the mid-length position and the adjacent quadrant position of the co-ordinate of preferred in-board location. Self-evidently, these procedures may be continued on an iterative basis, and may then reveal more favourable combinations.

Investigations of much lower stiffness panel members on the basis of smoothness of power output have shown peaking for marginal transducer locations also at about the in-board co-ordinate position, but near as good at quarter length of panel edges, and generally markedly less criticality as to position along the edges in terms of actual achieved modal distribution. This is seen as explicable by interaction between the lower panel stiffness and compliance within the used transducer itself. It appears that the resonant modal distribution of the panel is affected and altered by the transducer location, at least to some extent going with such location. Higher panel stiffnesses substantially avoid such effects. However, such in-transducer compliance and possible interaction with panel stiffness/elasticity is clearly another factor to be taken into account, including exploited usefully.

Investigations of panel members with quite high and much lower stiffnesses clearly reveal rather different cases for application of marginal excitation, including as to more and less criticality as to transducer locations, whether singly or in pairs, and as to less or more interaction with in-transducer compliance. It is thus appropriate to consider a panel member of intermediate stiffness.

For such intermediate stiffness panel member, and much as expected, differences relative to the much lower stiffness panel member include increase in acoustic power output available by edge clamping, markedly increased power for mid-range frequency modes, and stronger modality or peakiness for lower-frequency modes. Tendency towards characteristics of the higher stiffness panel member include stronger preference as best single transducer locations for edge positions on a co-ordinate of optimal in-board transducer locations, also promising feasibility for through the mid-point, but perhaps also at about one-tenth in from corners. For two marginally located transducers, marked preference resulted for the co-ordinate related position of optimal in-board transducer location, with less good but likely viable spread to middle and two-thirds length positions and equality of same quadrant co-ordinate related and two-thirds length positions.

It is evident that differences in materials parameters of panel members beyond basic capability to sustain bending wave action are significant in determining marginal transducer locations; and that use of two or more such transducer locations produces highly individual solutions requiring experimental assessment such as now enabled by teachings hereof.

Also, at least specifically for tested substantially rectangular panel members, it has been found that many if not most, probably going on all, of edge or near-edge locations for transducers that are unpromising as such can be significantly improved (as to bending wave dependent resonant mode distribution and excitement into acoustical response of the member) if associated with localised mass-loading or clamping at one or more selected other marginal position(s) of the panel member concerned. Inventive aspects thus includes association of a said drive position with helpful other mass-loading or clamping position marginal of the panel member.

Regarding use of two or more transducers, exhaustive investigation of combinations of marginal locations is impractical, but teaching is given as to how to find best and other viable marginal locations for a second transducer for any given first transducer marginal location. Indeed, yet further marginal transducer locations could be investigated and assessed according to the teaching hereof. Somewhat likewise, use of localised marginal damping for improving performance for any given transducer marginal location is investigatable and assessable to any extent and number using the teaching hereof, whether for enhancing or reducing contributions of some resonant mode(s), otherwise deliberately interfering with other resonant mode(s), or mainly to increase output power.

It believed to be worthwhile generally to take into account the fact that lowest resonant modes are related to length of the longest natural axis of any panel member, thus that longer edges of substantially rectangular panel members are sensibly always favoured for location of transducers, including doing so wherever feasible at the best position for operation with a single transducer. It is sensible to see this as applying even where use of another transducer is encouraged or intended, again whether for enhancing some resonant mode(s), deliberately interfering with other resonant mode(s) or mainly to increase output power.

Also relevant as a general matter is the fact that the operating frequency range of interest should be made part of assessment of location for transducers, and may well affect best and viable such locations, i.e. could be different for ranges wholly above and extending below such as 500 Hz. Another influencing factor could be presence of an adjacent surface, say behind the panel member at a spacing affecting acoustic performance.

It is inferred or postulated that the nature of preferred said edge or edge-adjacent position(s) tend towards what is fore-shadowed in our above patent application Ser. No. 08/707,012 and other patent applications, typically viewed as affording coupling to more approaching most frequency modes, and doing so more rather than less evenly, perhaps typically avoiding dominance of up to only a few frequency modes. Such suitability may be for lower rather than higher total actual vibrational energy locally in the panel member, but high as to population by frequency modes, i.e. rather than "dead" in the sense of little or no coupling to any or few modes.

BRIEF DESCRIPTION OF THE DRAWINGS

Specific implementation for the invention is now diagrammatically illustrated and described in and with reference to by way of example, in the accompanying drawings, in which.

DESCRIPTION OF ILLUSTRATED EMBODIMENTS

Figure 1:
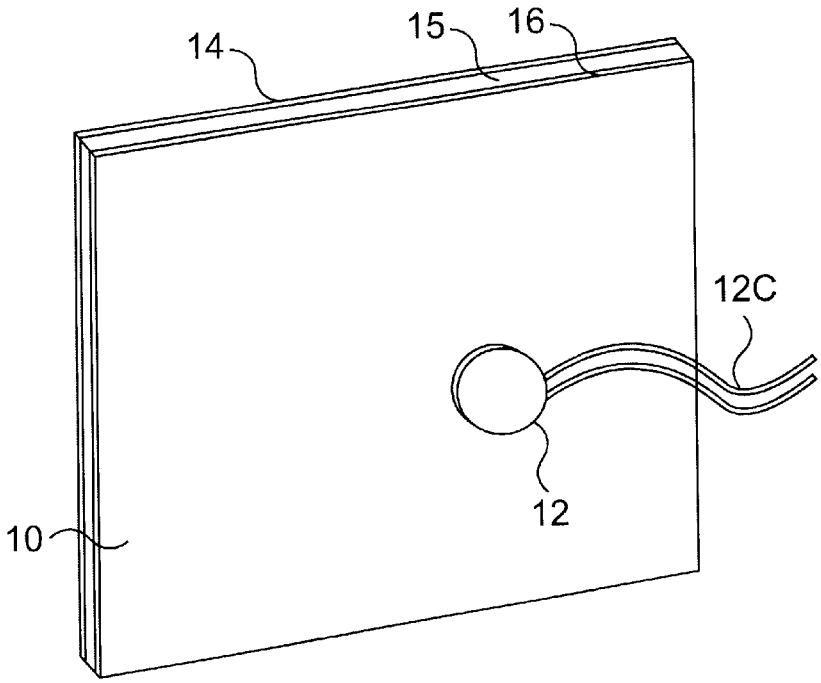
FIG. 1 shows a distributed mode acoustic panel with a fitted transducer as generally described in the above patent application Ser. No. 08/707,012.

In FIG. 1, distributed mode acoustic panel loud-speaker 10 is as described in patent application Ser. No. 08/707,012 with panel member 11 having typical optimal near- (but off-) centre location for drive transducer 12. The sandwich structure shown with core 14 and skins 15, 16 is exemplary only, there being many monolithic and/or reinforced and other structural possibilities. In any event, normal in-board transducer placement potentially limits clear area available, e.g. for such as transmission of light in the case of a transparent or translucent panel.

Figure 2:
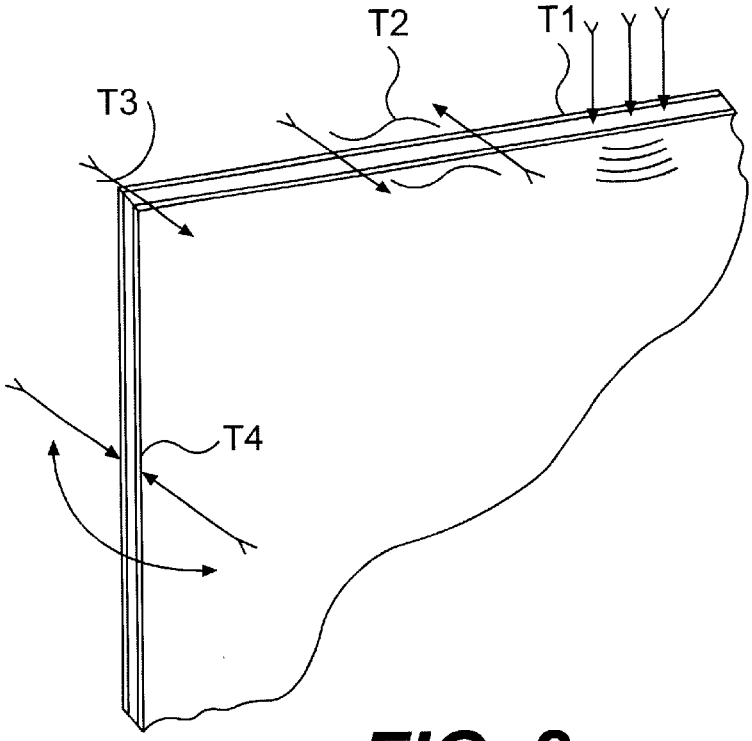
FIG. 2 shows outline indication of four different ways of marginal or edge excitation an acoustic panel.

Mainly transparent or translucent resonant mode acoustic panel members might use known transparent piezo-electric transducers, e.g. of lanthanum doped titanium zirconate. However these are relatively costly, hence the alternative approach thereof by which it is possible to leave the resonant mode acoustic panel member 10 mainly clear and unobstructed by optimising loudspeaker design from a choice of four types of excitation shown in FIG. 2 directed to the margins or perimeter of the panel, and labelled as types T1–T4, as follows:

T1—launching compression waves into an edge (shown along 18A) of the panel member 11—as available by inertial action or reference plane related drive transducers T2—launching transverse bending waves along an edge (also shown along 18A) of the panel member 11—as available by laterally deflecting the panel edge using bender action drive transducers T3—applying torsion to the panel member 11—as shown across a corner between edges 18A, B—available by action of either of bender or inertial type drive transducers T4—producing linear deflection directly at an edge of the panel member 11 as shown at edge 18B—available at local region of contact by inertial action drive transducers.

Figure 3:
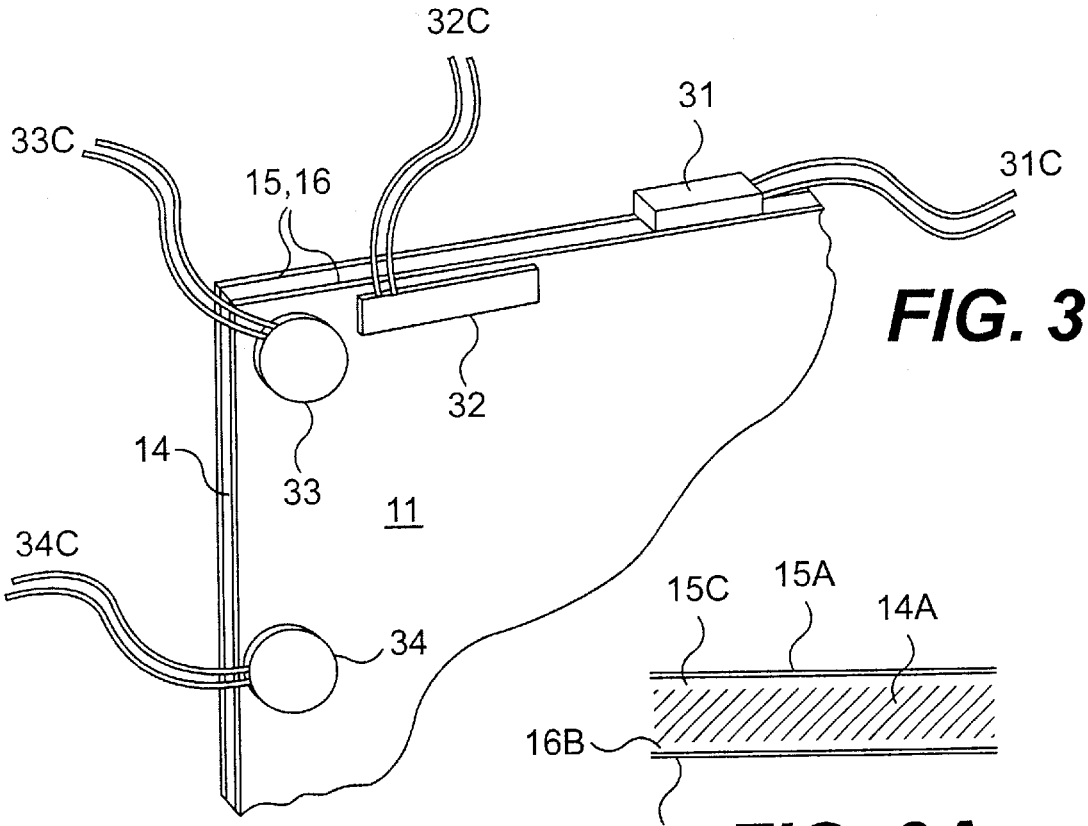
FIG. 3 shows possible placements of transducers marginally of an acoustic panel to achieve actions shown in FIG. 2.
Figure 3A:
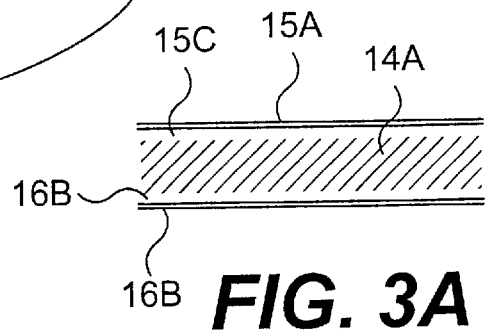
FIG. 3A shows transparent such panel.

FIG. 3 is a scrap view of composite panel 11 showing high tensile skins 15, 16 and structural core 14 with drive transducers/exciters 31–34 for the above-mentioned four types T1–T4 of edge/marginal drive. In practice, fewer than four drive types might be used at the same time on a panel which can usefully be acoustically and mechanically optimised for the desired bandwidth of operation and for the particular type of drive employed. Thus, an optimised panel may be driven by any one or more of the different drive types.

Figure 11A:
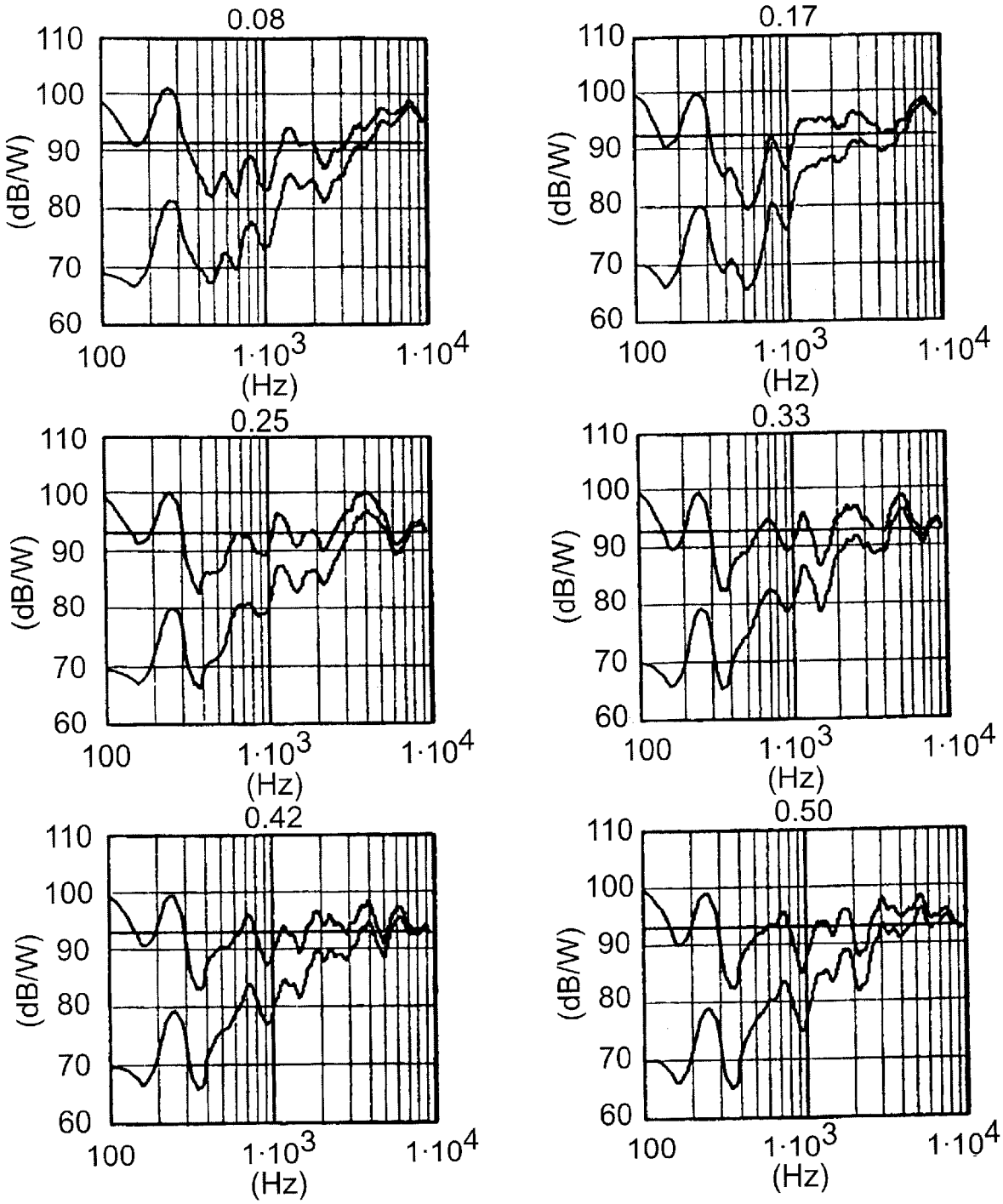
FIGS. 11A, B are graphs of output power/frequency for a substantially rectangular panel member of quite high stiffness and single transducer positions along longer and shorter edges.
Figure 11B:
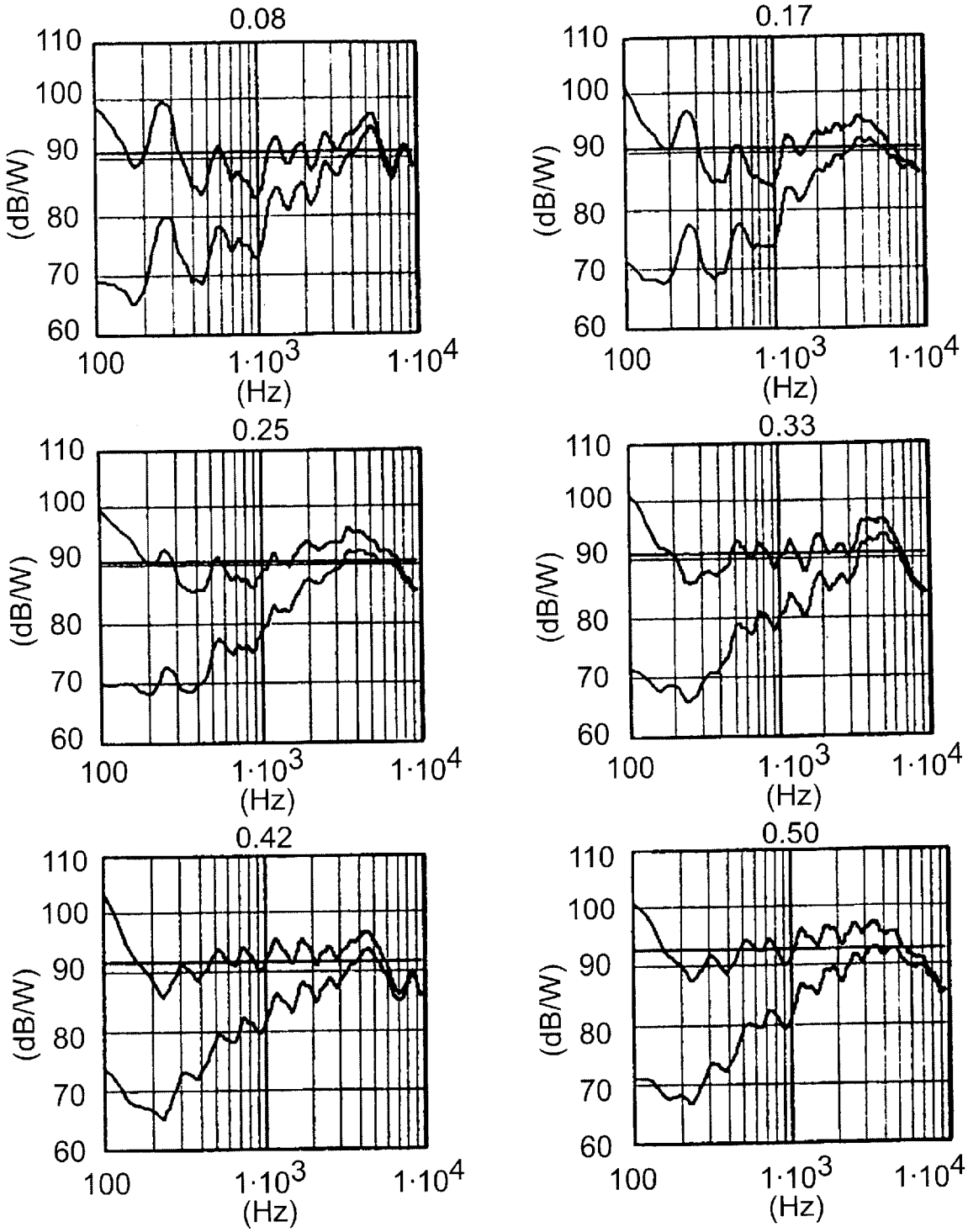
Figure 12A:
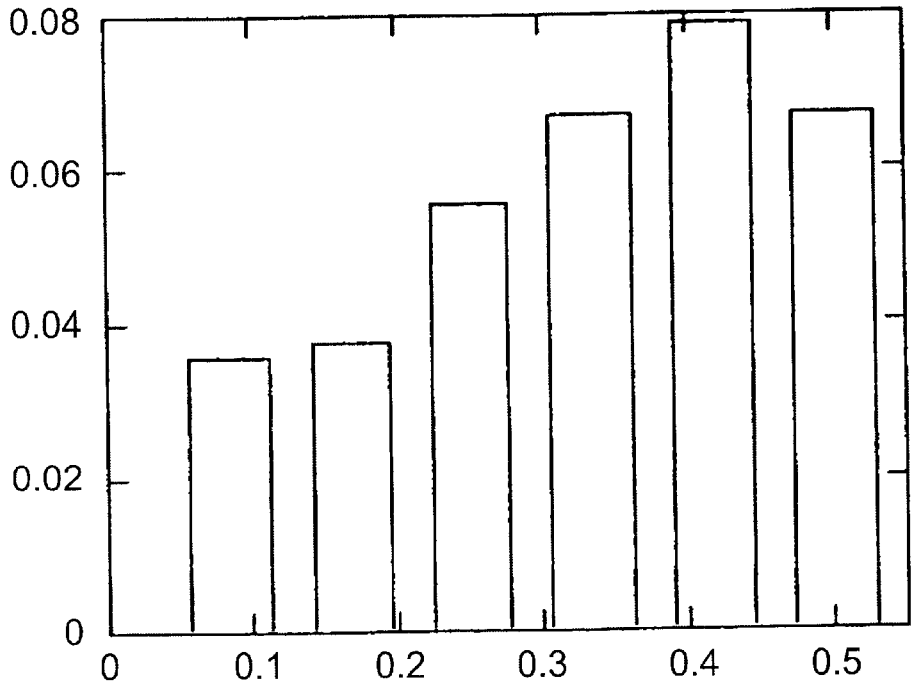
FIGS. 12A, B are related bar charts for measures of smoothness of output power.
Figure 12B:
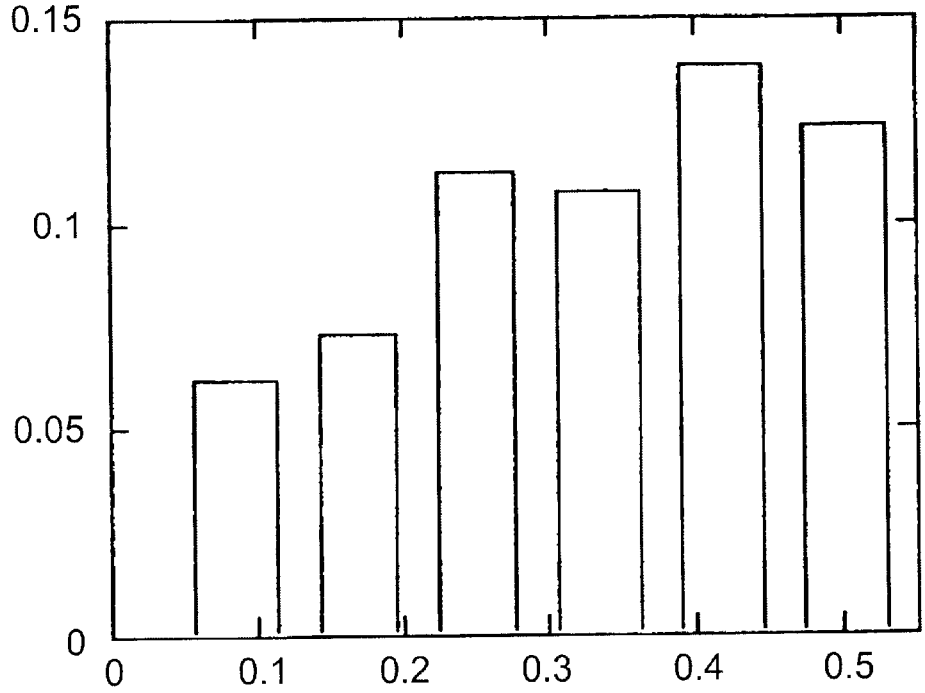

A transparent or translucent edge-driven acoustic panel could be monolithic, e.g. of glass, or of skinned core structure using suitable translucent/transparent core and skin materials, see FIG. 11. Interpretation with a visual display unit (VDU) may enable the screen also to be used as a loudspeaker, can have suitably high bending stiffness along with low mass if comprising a pair of skins 15A, 16A sandwiching a lightweight core of aerogel material 14A using transparent adhesive 15B, 16B. Aerogel materials are extremely light porous solid materials, say of silica. Transparent or translucent skin or skins may be of laminated structure and/or made from transparent plastics material such a polyester, or from glass. Conventional transparent VDU screens may be replaced by such a transparent acoustic radiator panel, including with acoustic excitation outside unobstructed main screen area. A particular suitable silica aerogel core material is (RTM) BASOGEL from BASF. Other feasible core materials could include less familiar aerogel-forming materials including metal oxides such as iron and tin oxide, organic polymers, natural gels, and carbon aerogels. A particular suitable plastics skin laminates may be of polyethylene terephthalate (RTM) MYLAR, or other transparent materials with the correct thickness, modulus and density. Very high shear modulus of aerogels allow extremely thin composites to be made to suit miniaturisation and other physically important factors and working under distributed mode acoustic principles.

If desired, such transparent panel could be added to an existing VDU panel, say incorporated as an integral front plate. For a plasma type display the interior is held at low gas pressure, close to vacuum, and is of very low acoustic impedance. Consequently there will be negligible acoustic interaction behind the sound radiator, resulting in improved performance, and the saving of the usual front plate. For film type display technologies, again the front transparent window may be built using a distributed mode radiator while the display structures behind may be dimensioned and specified to include acoustic properties which aid the radiation of sound from the front panel. For example partial acoustic transparency for the rear display structures will reduce back wave reflection and improve performance for the distributed mode speaker element. In the case of the light emitting class of display, these may be deposited on the rear surface of the transparent distributed mode panel, without significant impediment to its acoustic properties, the images being viewed from the front side.

A transparent distributed mode loudspeaker may also have application for rear projection systems where it may be additional to a translucent screen or this function may itself be incorporated with a suitably prepared surface for rear projection. In this case the projection surface and the screen may be one component both for convenience and economy but also for optimising acoustic performance. The rear skin may be selected to take a projected image, or alternatively, the optical properties of the core may be chosen for projection use. For example in the case of a loudspeaker panel having a relatively thin core, full optical transparency may not be required or be ideal, allowing the choice of alternative light transmitting cores, e.g. other grades of aerogel or more economical substitutes. Special optical properties may be combined with the core and/or the skin surface to generate directional and brightness enhancing properties for the transmitted optical images.

Where the transparent distributed mode speaker has an exposed front face it may be enhanced, for example, by the provision of conductive pads or regions, visible, or transparent, for user input of data or commands to the screen. The transparent panel may also be enhanced by optical coatings to reduce reflections and/or improve scratch resistance, or simply by anti scratch coatings. The core and skin for the transparent panel may be selected to have an optical tint, for colour shading or in a neutral hue to improve the visual contrast ratios for the display used with or incorporated in the distributed mode transparent panel speaker. During manufacture of the transparent distributed model panel, invisible wiring, e.g. in the form of micro-wires, or transparent conductive films, may be incorporated together with indicators, e.g. light emitting diodes (LED) or liquid crystal displays (LCD) or similar, allowing their integration into the transparent panel and consequent protection, the technique also minimising impairment to the acoustic performance. Designs may also be produced where total transparency is not required, e.g. where one skin only of the panel has transparency to provide a view to an integral display under that surface.

The transducers may be piezo-electric or electro-dynamic according to design criteria including price and performance considerations, and are represented in FIG. 3 as simple outline elements simply bonded to the panel by suitable adhesive(s). For above T1 type drive excitation, inertial transducer 31 is shown driving vertically directed compression waves into the panel 30. For above T2 type of drive excitation, bending type of transducer 32 is shown operative for directly bending regionally to launch bending waves through the loudspeaker panel 30. For above T3 type of drive excitation, inertial transducer 33 is shown serving to deflect the panel corner in driving into the diagonal and thence into the whole loudspeaker panel 30. For above type T4 drive excitation another inertial transducer 34 is shown of block or semi-circular, form serving to deflect an edge of the loudspeaker panel 30.

Each type of excitation will engender its own characteristic drive to the panel 30 which is accounted for in the overall loudspeaker design including parameters of the panel 30 itself. The placement of the transducers 31–34 along the panel edge is in practice iterated with the panel design parameters for optimum or at least operationally acceptable modal distribution of bending waves. It is envisaged that, according to the panel characteristics, including such as controlled loss for example, and the location(s) and type(s) of marginal edge or near-edge drive, more than one audio channel may be applied to the panel 30 concerned, e.g. via plural drive transducers. This multi-channel potential may be augmented by signal processing to optimise the sound quality, and/or to control the sound radiation properties and/or even to modify the perceived channel-to-channel separation and spatial effects.

Figure 4:
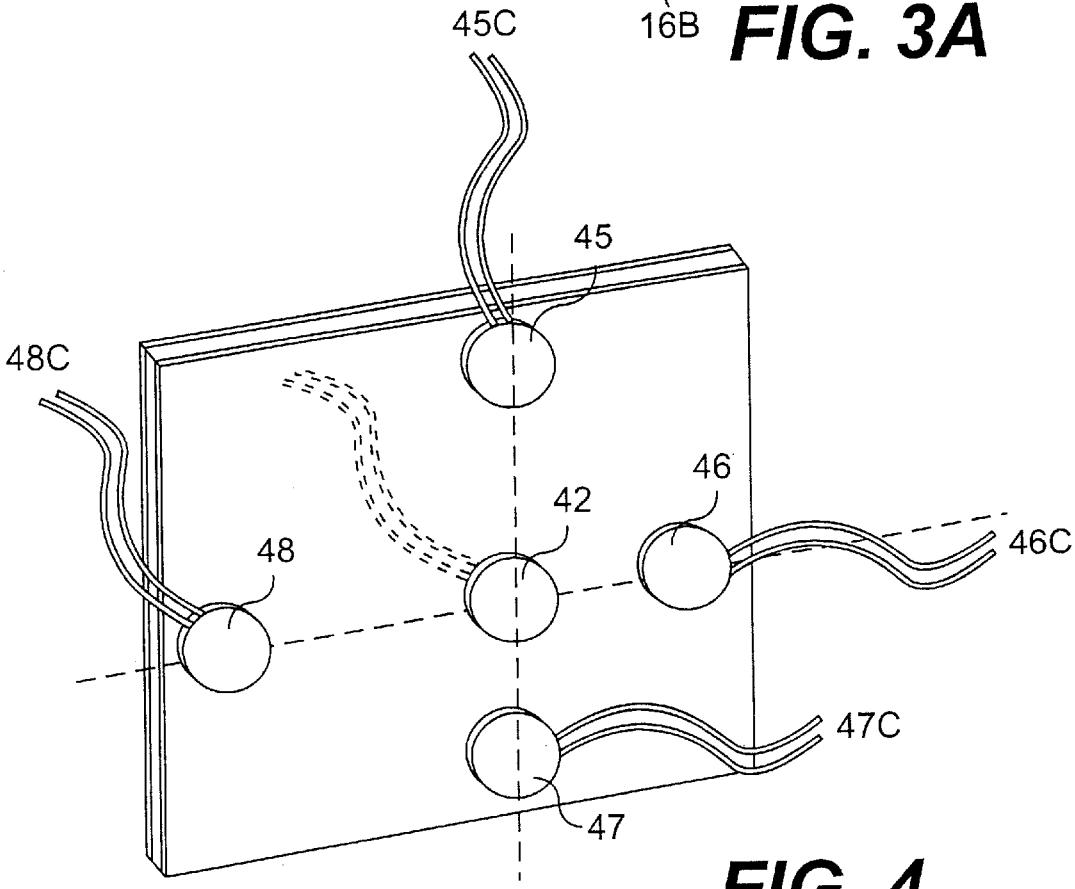
FIG. 4 shows four favoured marginal locations for transducers shown in outline, relative to an in-board location of FIG. 1 shown in phantom.
Figure 5:
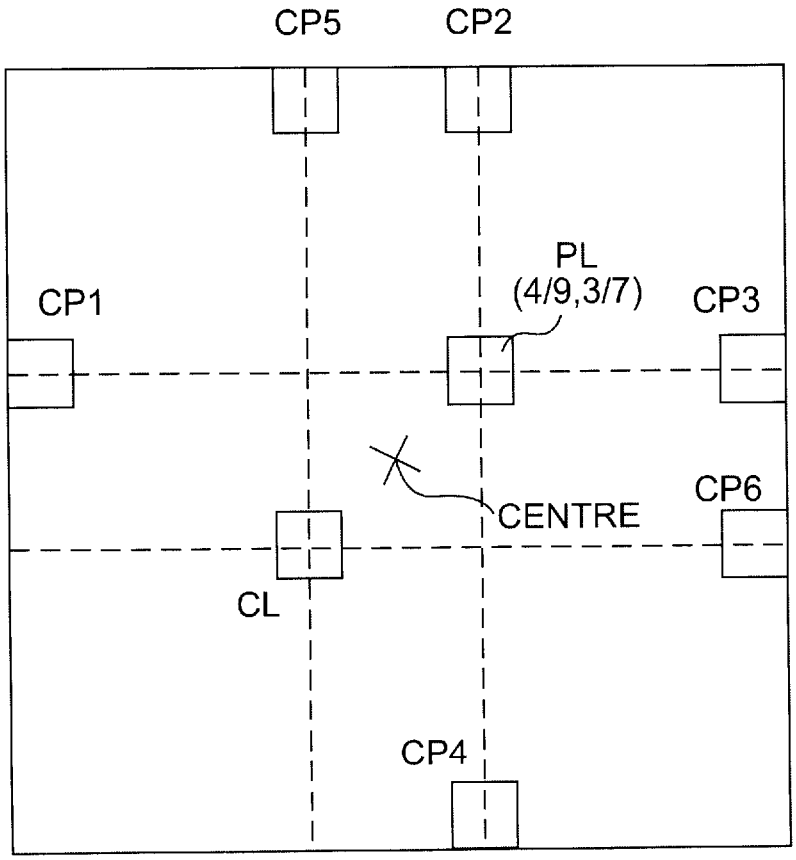
FIG. 5 shows the same four favoured locations relative to another preferential in-board drive location and favoured pair of the complementary or phantom in-board drive location.
Figure 6:
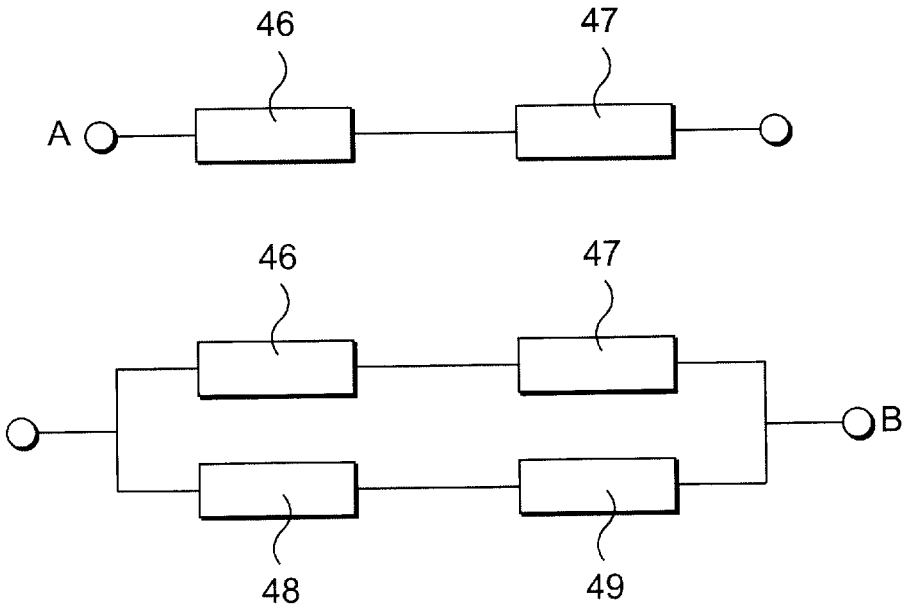
FIG. 6 indicates how any pairs and all four drive transducers at such favoured locations were connected for testing.

Particularly satisfactory drive transducer locations along edges of a substantially rectangular panel member are at edge positions reached by orthogonal side-parallel lines or co-ordinates through an in-board optimal or preferential drive transducer position according to our above PCT application, see dashed at 42 to 45–48 in FIG. 4. It is actually practical to use drive transducers at at least two such co-ordinate related edge locations 45–48. FIG. 6 shows in-phase serial and serial/parallel connections for two and four drive transducers at A and B. Other drive connections are feasible, and may often be preferred, including directly one-to-one to each transducer; and any desirable signal conditioning may be applied, e.g. differential delay(s), filtering etc, say to suit reduction of undesirable interaction between transducers and/or with electrical signal source and favoured drive transducer positions CP1–CP4 in FIG. 5 relative to in-board preferential location PL. Pairing can be one from each co-ordinate, i.e. CP1 and CP2, CP2 and CP3, CP3 and CP4, CP4 and CP1, and a first favoured pairing is the one notionally defining included area that is greatest, indeed, contains the geometrical centre X. Such notional area will, of course, further pass through or contain other usual optimal or preferential in-board drive transducer position, see complementary location CL and indication at CP5 and CP6 for the first favoured pairing of drive transducer locations.

It has been interesting to note for a very high Q panel that preferred and most preferred pairs of orthogonal co-ordinate related drive locations can produce low frequency output that may be more extended and uniform even than prior preferential in-board much nearer centre positions, albeit with some moderate variation in the higher frequency range. Off-axis response is similar at higher frequencies but actually somewhat more symmetrical at lower frequencies.

Figure 7:
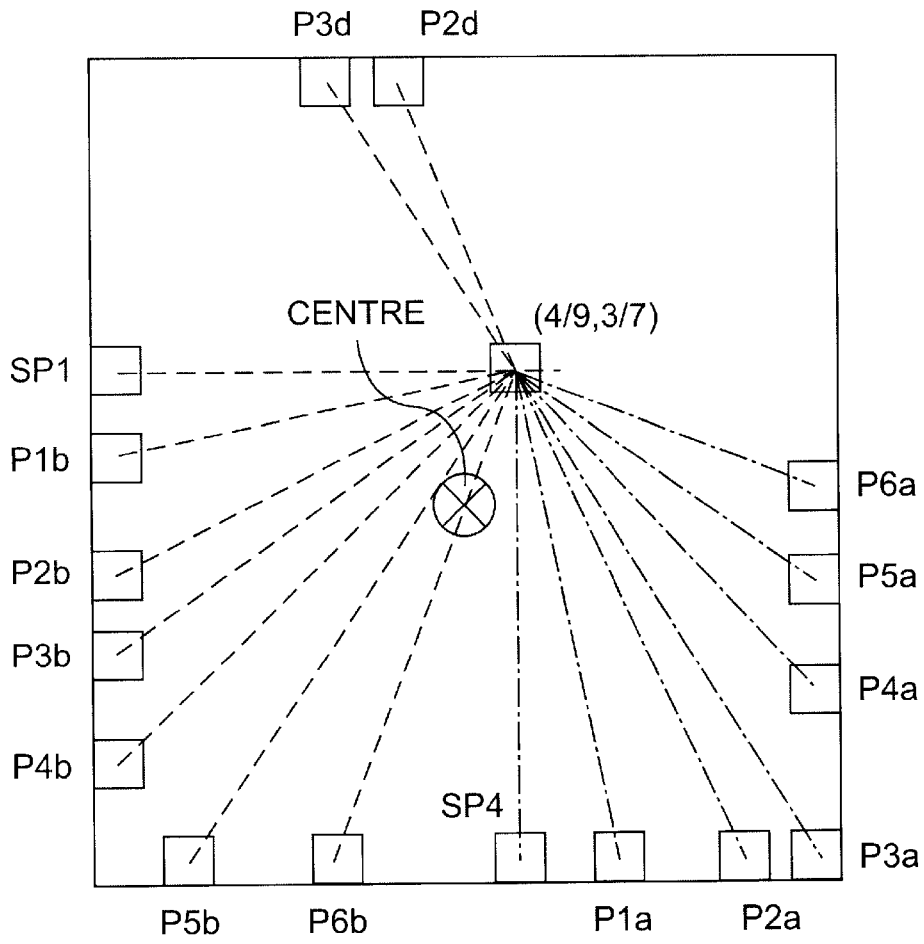
FIG. 7 shows viable if less favoured pairs of marginal drive transducer locations.

FIG. 7 shows select results of an experiment where pairs of transducers for which orthogonal angular relative relation is maintained centred on above normal inboard preferential transducer location, specifically most beneficial for co-ordinate related marginal drive locations SP1 and SP4, but the transducers are tested at positions relatively translated round the panel edge. Most viable/promising pairs of locations are indicated at pairs of positions 1*a*, 1*b* to 6*a*, 6*d*. FIG. 7 actually also shows results of another experiment where pairs of transducers were at opposite ends of straight lines through the preferential in-board drive location SP1, 2. Fewer viable/promising locations were found at positions 2*a*, 2*d* and 3*a*, 3*d*. More experimental work may well be worthwhile relative to other pairs or more of edge-drive positions, and theoretical/systematising work is being attempted. It will be appreciated from dimensions quoted and as measured at pairs of positions giving viable/promising measured/assessed results that FIG. 7 is not strictly to scale.

Figure 8:
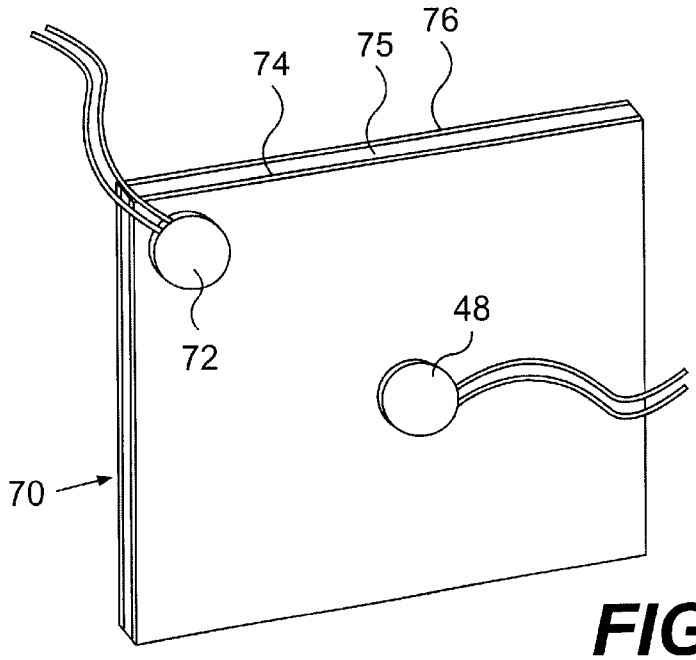
FIG. 8 shows corner drive position and helpful mass-loading at an in-board preferential drive location.

FIG. 8 shows a panel 70 of core 74 and skins 75, 76 structure, and having near-corner-mounted transducer 72 with mass loading 78 substantially at an otherwise normal in-board preferential transducer, actually the one or in the group furthest away from the corner of excitation by the transducer 72, which is found to be particularly effective in appearing to behave as a "virtual" source of bending wave vibrations. It can be advantageous for the transducer to avoid or at least couple outside a position with a co-ordinate location substantially centred at 5% of side dimensions from the corner as such, where it has been established that many resonant mode(s) have nodes, i.e. low vibrational activity.

Figure 9:
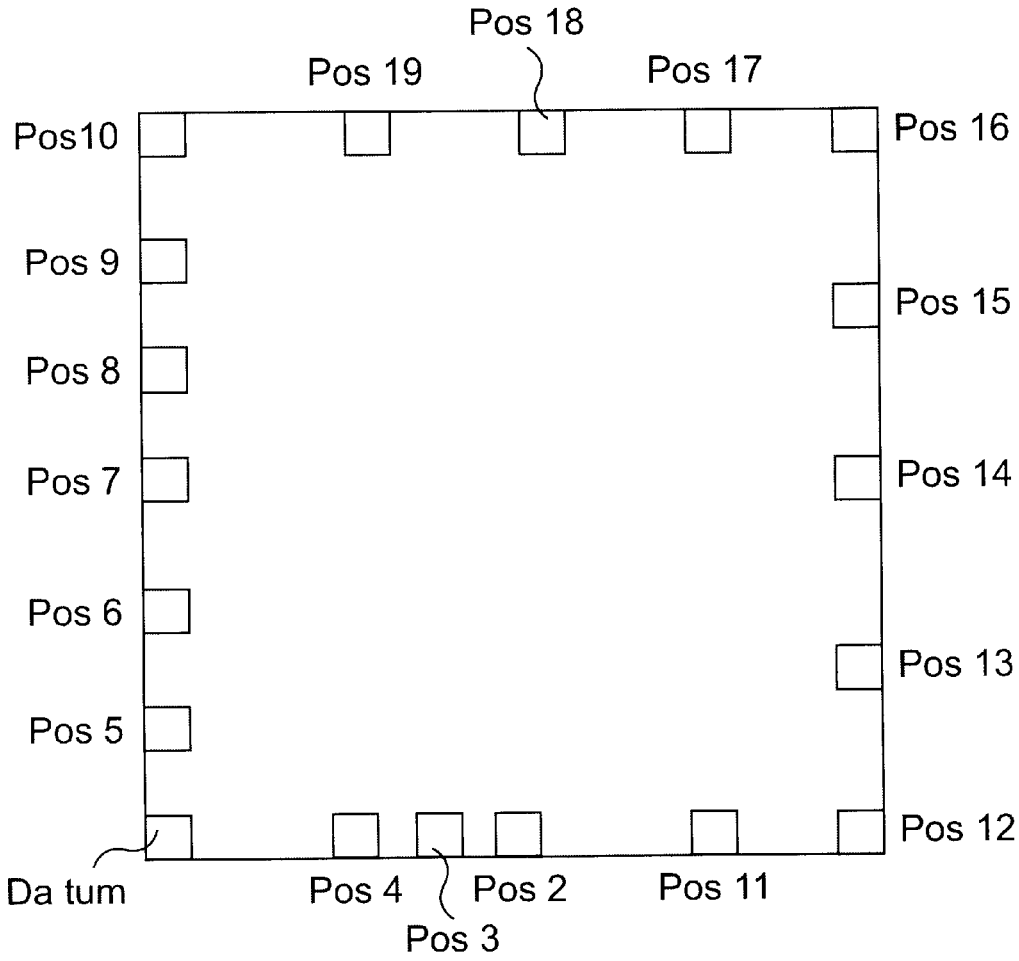
FIGS. 9 and 9A show four normally unfavoured marginal drive transducer locations together with many marginal mass-loading or clamping positions and how test masses and drive transducers were associated with the panel.

Turning to FIG. 9, outline is indicated for an investigation involving select single positions for one Sedge or edge-adjacent transducer mounting, see at ST1–ST4 for in-corner, half-side length, quarter-side length and three-eights side-length, respectively; and select positions for edge-clamping/mass-loading at edge positions about the panel. An exciting transducer was used, see 92 in FIG. 9A relative to panel 90, along with loads/clamps by way of panel flanking/gripping 93A/B magnets.

Figure 9A:
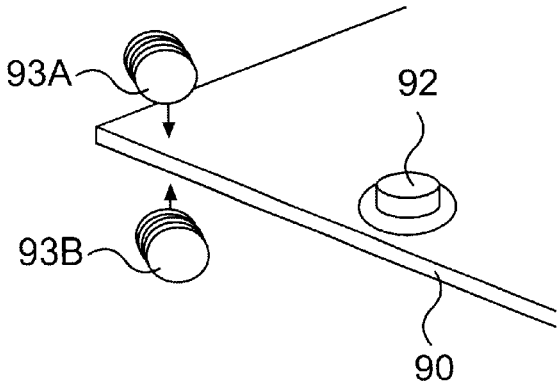

Performance using the corner exciting transducer position ST1 was aided by mass-loading as in FIG. 9A at positions Pos. 13, 14, 18, 19—including in further combination with other positions. For exciting transducer position ST2, good single mass-loading positions are Pos. 6, 7, 8 perhaps 9, 11 particularly, 12, 15—again including combinations with other positions. Combinations 5=11 and 6+11 were of particular value, including in further combinations. For exciting transducer position ST3, good single mass-loading positions are Pos. 5, 6, 7, 13, especially the combinations 5+13 and 10+13, the combination 6+18, and combinations/further combinations.

For exciting transducer position ST4, best positions appear to be 6, 18 but neither was as good as those for the other exciter positions ST1–ST3.

Figure 10:
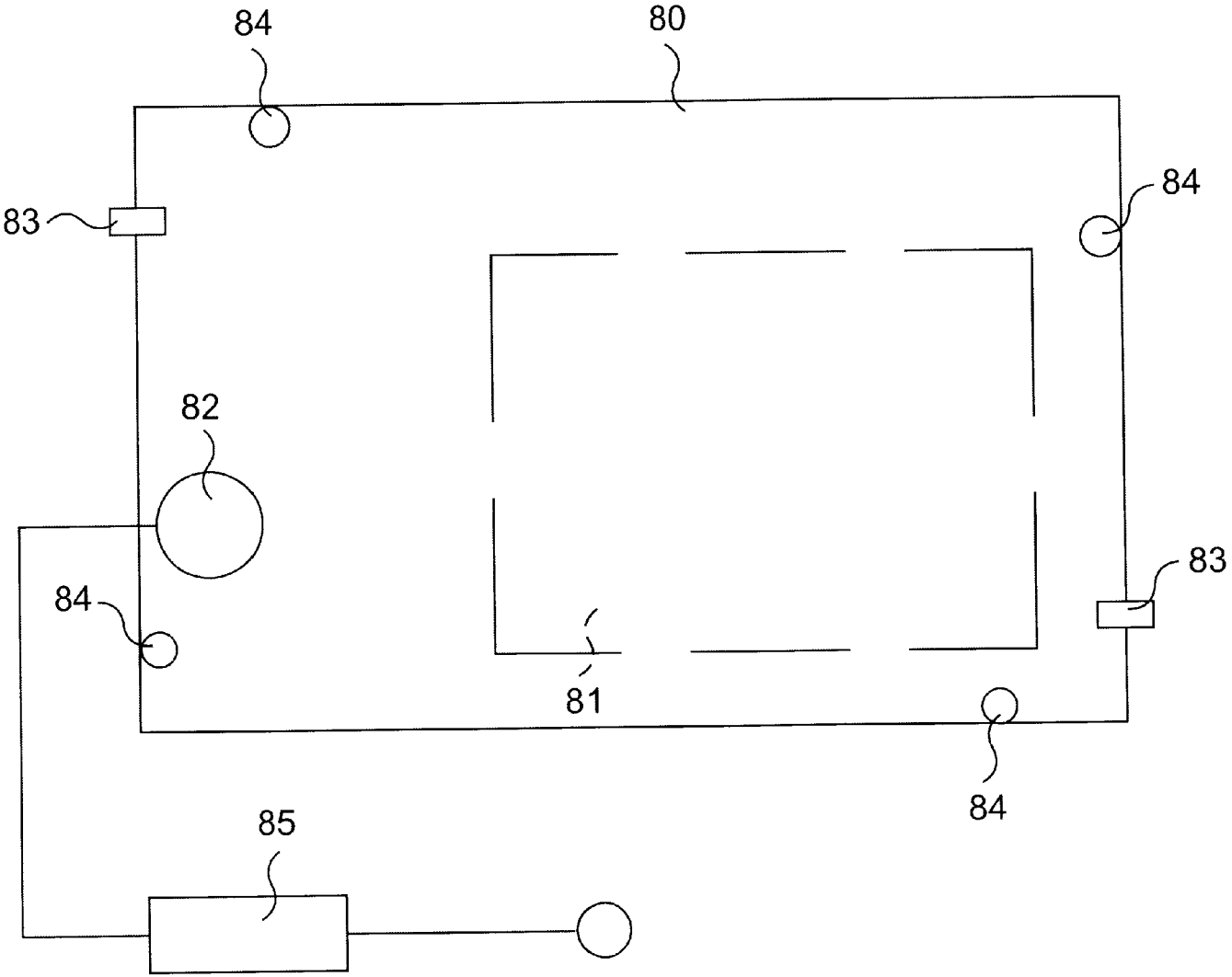
FIG. 10 shows in-board area unobstructed within marginal positions for drive transducer(s), clamp termination(s) and resilient suspension/mounting.

FIG. 10 shows a panel-form loudspeaker 80 having an in-board unobstructed region 81 extending throughout and beyond normal in-board preferential drive transducer locations, and a marginally located transducer 82. The region 81 may serve for display purposes directly, or represent something carried by the panel 80 without affecting acoustic performance, or something behind which the loudspeaker panel 80 passes, say in close spacing and/or transparent or translucent. Both of loudness and quality are readily enhanced, the former by additional drive transducers judiciously placed (not shown), and quality by localised edge clamping(s) 83 beneficially to control particular modal vibration points effectively as panel termination(s). The panel 80 is further indicated with localised resilient suspensions 84 located neutrally or even beneficially regarding achieved acoustic performance. High pass filtering 85 is preferred for input signals to drive transducer(s) 82, conveniently to limit to range of best reproduction, say not below 100 Hz for A4-size or similar panels. Then, there should not be any problematic low-frequency panel/exciter vibration.

It is advantageous in terms for acoustic performance to control acoustic impedance loading on the panel 80, say to be relatively low in the marginal or peripheral region, especially in the vicinity of the drive transducer(s) 82 where surface velocity tends to be high. Beneficial such control provision includes significant clearance to local planar members (say about 1–3 centimeter) and/or slots or other apertures in adjacent peripheral framing or support provision or grille elements.

It is further feasible and advantageous deliberately to arrange for such as mechanical damping to result in acoustic modification including loss in the area 81, or even also marginally thereof, not to be obstructed, at least for higher frequencies. This may be done by choice of materials, e.g. monolithic polycarbonate or acrylic and/or suitable surface coating or laminated construction. Resulting effective concentration of acoustic radiation to marginal regions about plural drive transducers particularly facilitates reproduction of more than one sound channel, at least for near-field listening as for playing computer games or like localised virtual sound stage applications. Further away, merging even of multiple as-energised sound sources need not be problematic when summed, at least for such as audio visual presentations.

The following Table gives relevant physical parameters of actual panel members used for investigation to which FIGS. 11–28 relate.

| | Lower Stiffness Panel | Higher Stiffness Panel | Intermediate Stiffness panel |
|---|---|---|---|
| Core material | Rohacell | Al honeycomb | Rohacell |
| Core thickness | 1.5 mm | 4 mm | 1.8 mm |
| Skin material | Melinex | Black glass | Black glass |
| Skin thickness | 50 $\mu$m | 102 $\mu$m | 102 $\mu$m |
| Panel Area | 0.06 m2 | 0.06 m2 | 0.06 m |
| Aspect ratio | 1:1.13 | 1:1.13 | 1:1.13 |
| Bending stiffness | 0.32 Nm | 12.26 Nm | 2.47 Nm |
| Mass density | 0.35 $kgm^{-2}$ | 0.76 $kgm^{-2}$ | 0.6 $kgm^{-2}$ |
| Zm | 2.7 $Nsm^{-1}$ | 24.4 $Nsm^{-1}$ | 9.73 $Nsm^{-1}$ |

FIGS. 11–14 relate to the higher stiffness panel member of the first column, FIGS. 15–24 to the much lower stiffness panel member of the second column, and FIGS. 25–28 to the intermediate stiffness panel member of the third column.

All of the graphs have acoustic output power (dB/W) as ordinate and frequency as abscissa, thus show measured acoustic output power as a formation of frequency, typically as a truly plotted dotted line. Most of the graphs also show an upper adjustment of the true power line. As mentioned in the preamble, this adjustment is by way of applying functions that normalise to a flat straight line, and allows assessment of resonant modality free of often encountered effects of fall-off of power at lower frequencies. It is found that smoothness of power makes significant contribution to quality of sound. From such normalised value of the actual power output, it is advantageous to produce assessment of smoothness by inverse of mean square deviation, and most of the bar plots are of that type.

The higher stiffness panel member for FIGS. 11–14 is actually somewhat less stiff than that used for previous FIGS. 7 and 9, but does clearly show preference for single transducers to be located at positions corresponding to co-ordinates of in-board transducer locations previously established as optimal, i.e. at about 3/7, 4/9 length from any corner or about 0.42–0.44. However, there are substantial spreads of promising potential location between and beyond such positions for each edge, actually within about 10% and 15% in the mid-regions of shorter and longer edges, respectively, and further within 28% and 30% at quarter-length positions.

At least for the most part, trial positions for transducer edge or near edge location are based on spacing substantially corresponding to the difference between the preferential co-ordinate value of 0.42 for in-board transducer location and the mid-point (0.5) of the edge, albeit with alternate spacings increased to 0.09. Usual trial locations are thus 0.08, 0.17, 0.28, 0.33, 0.42, 0.50.

In the main, it is believed that the illustrated graph and bar charts are substantially self-explanatory as to showing best and presumably promising locations for transducers, and for localised clamping as feasible for improving less promising transducer locations, see FIG. 23.

Figure 15A:
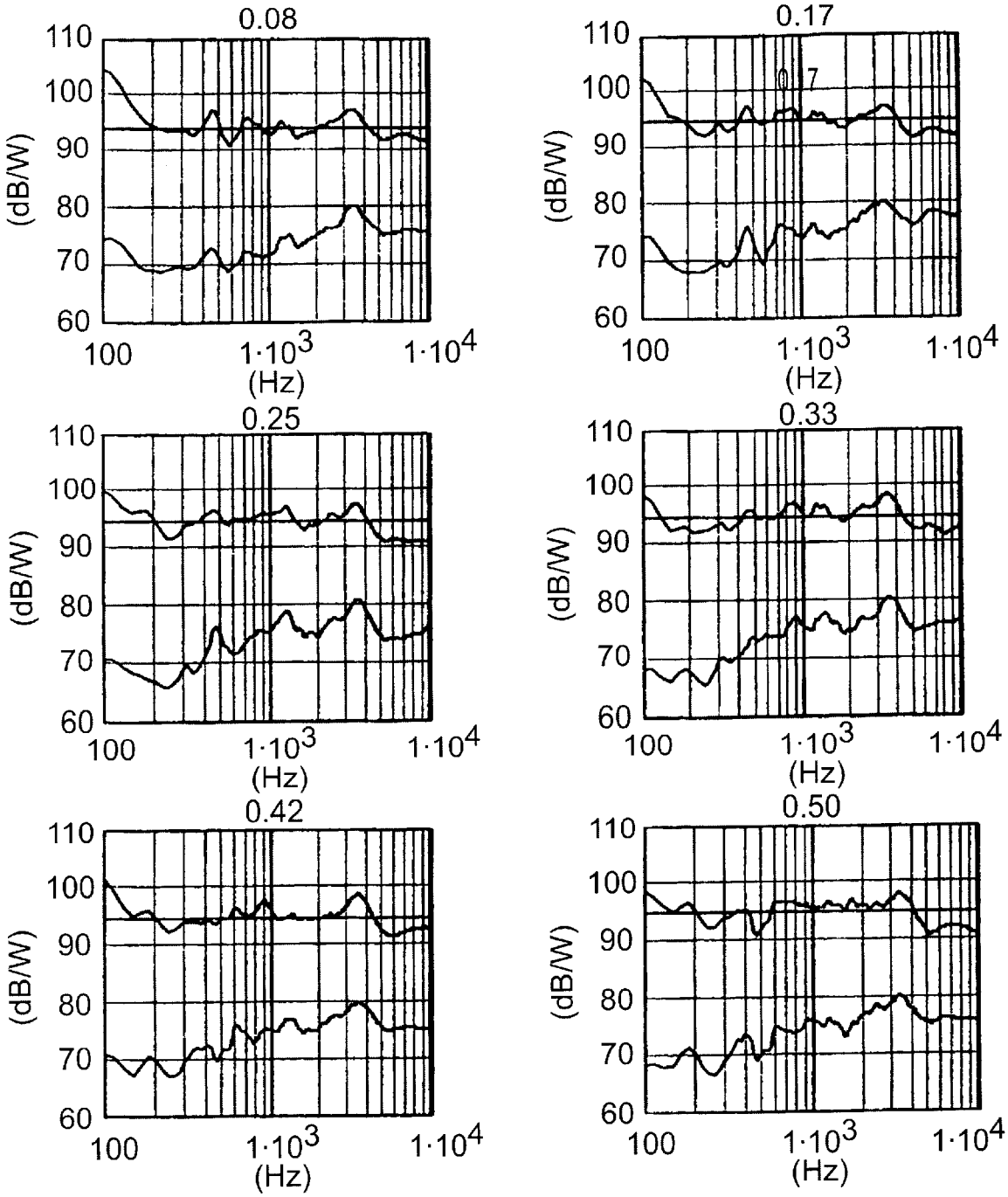
FIGS. 15A, B are output power/frequency graphs and related power smoothness bar chart for a panel member of much lower stiffness and single transducer positions along the longer edge.
Figure 15B:
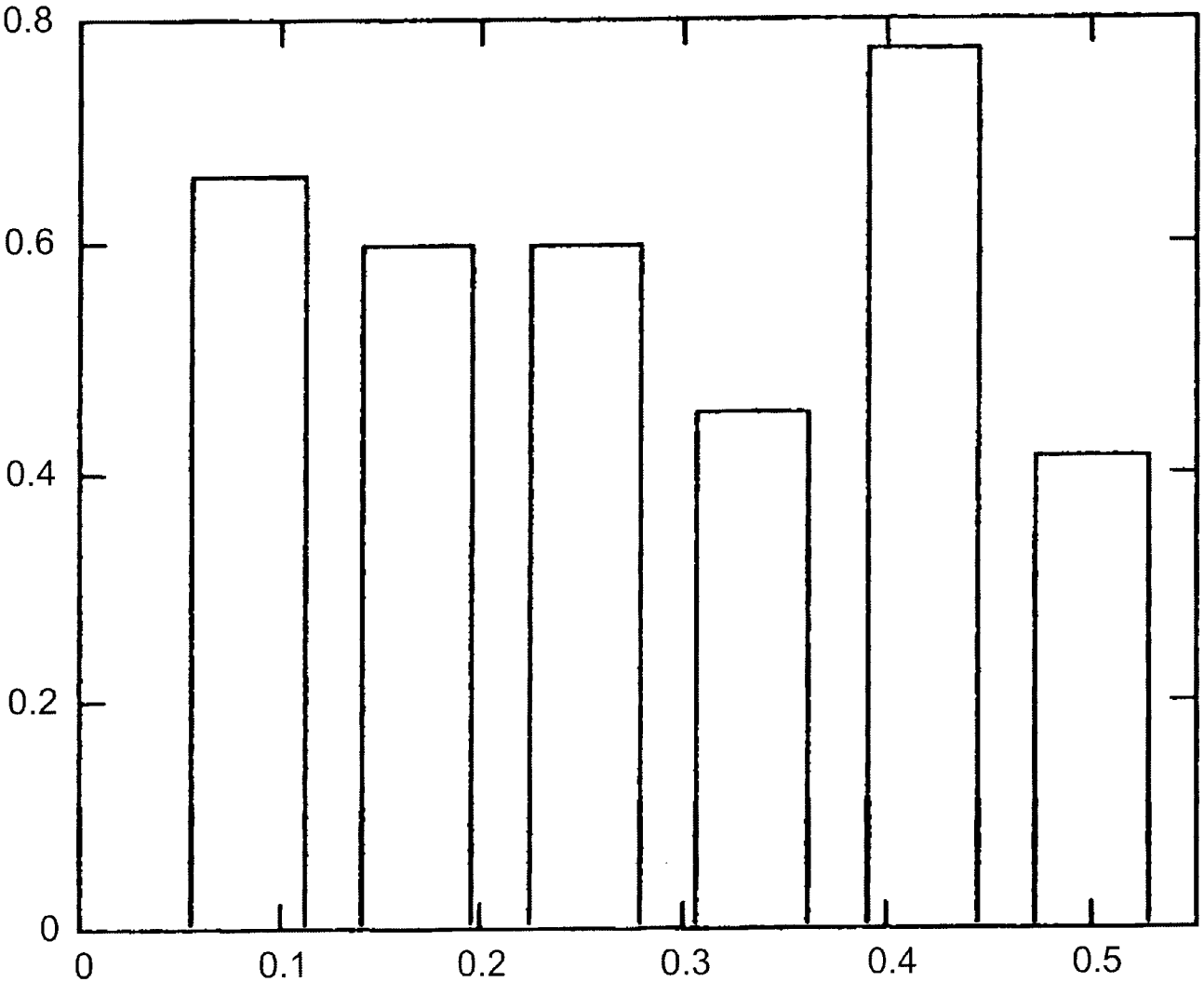
Figure 25A:
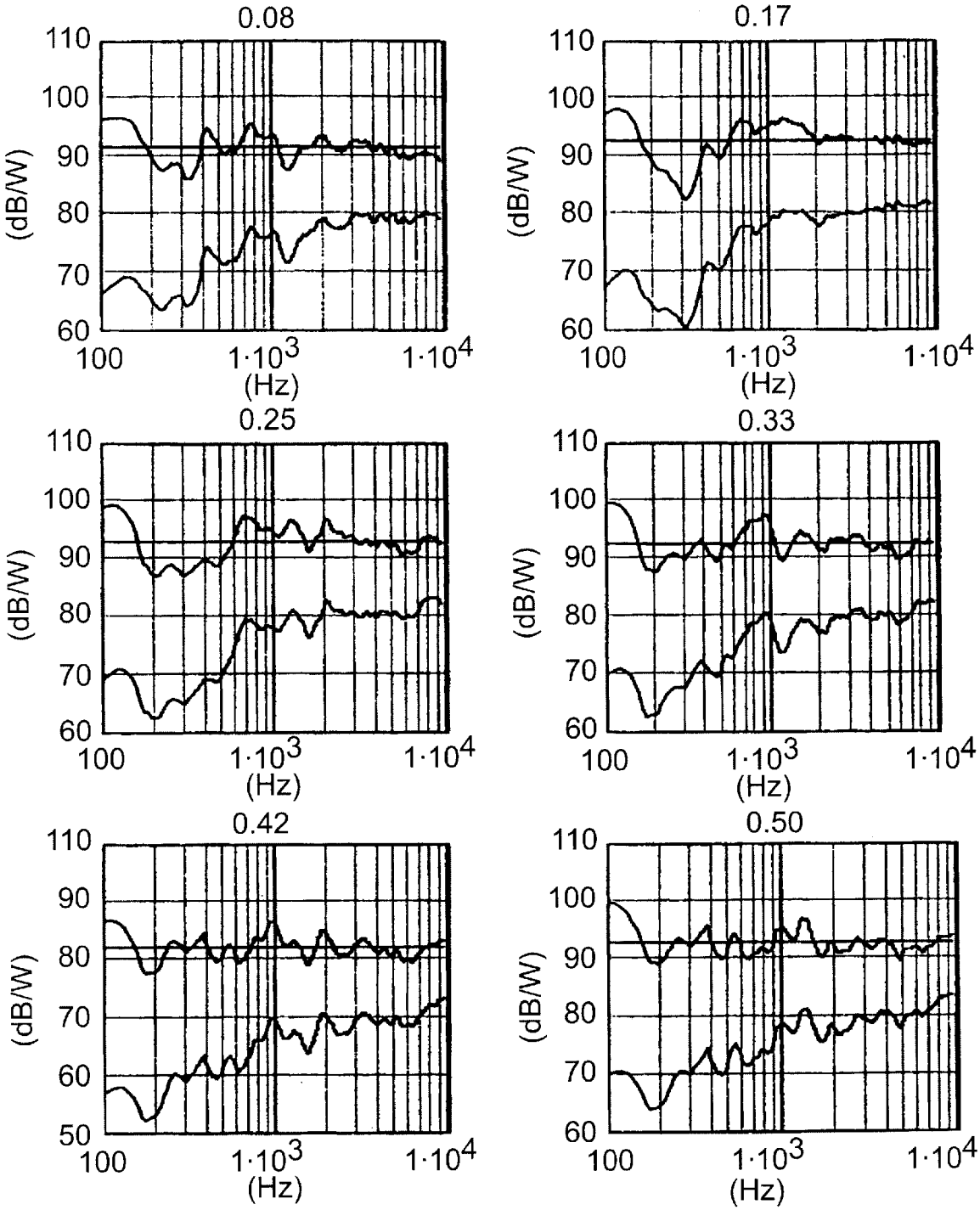
FIGS. 25A, B are power output/frequency graphs and related power smoothness bar charts for a panel member of intermediate stiffness and single transducer positions along the longer edge with normalisation.
Figure 25B:
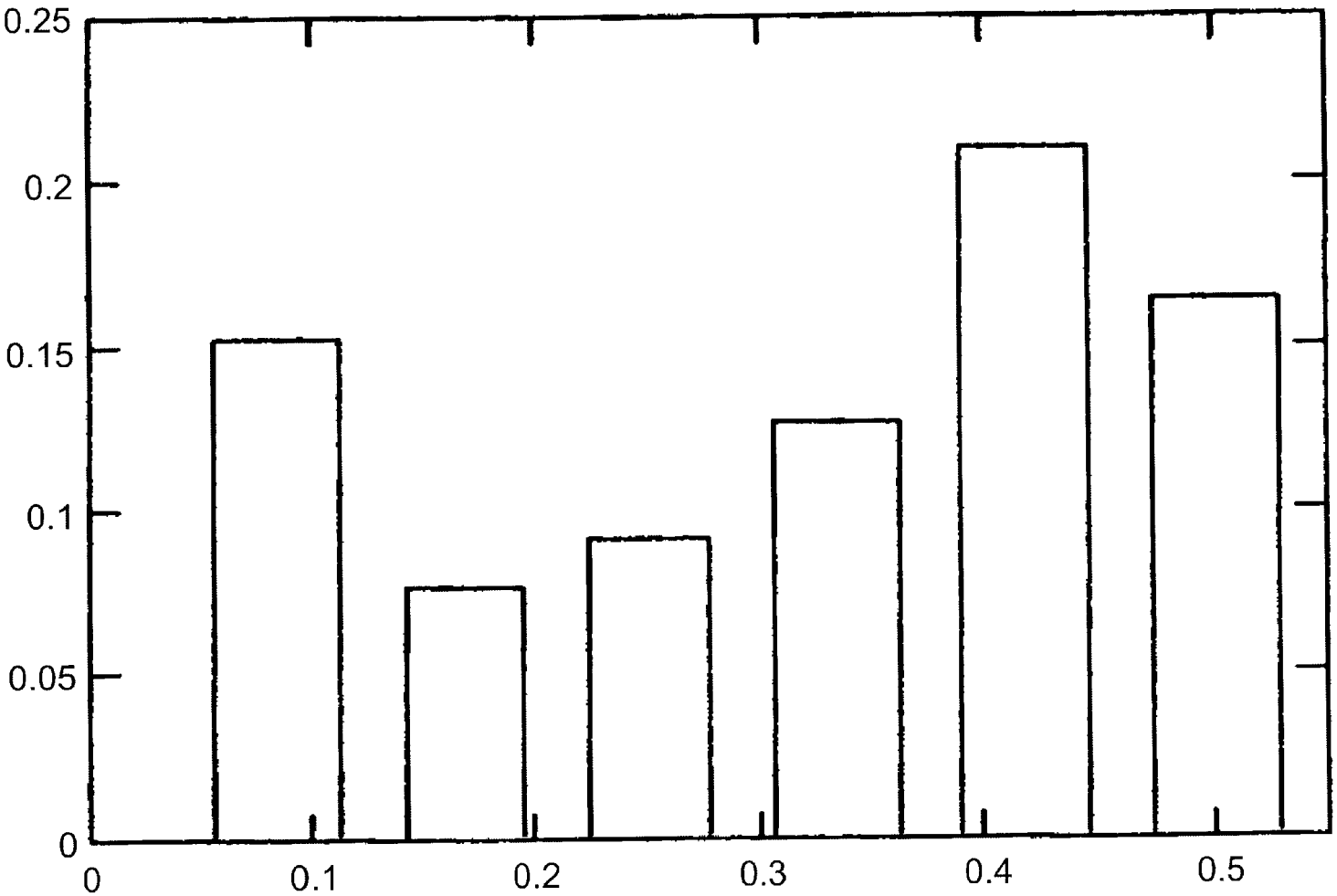
Figure 26A:
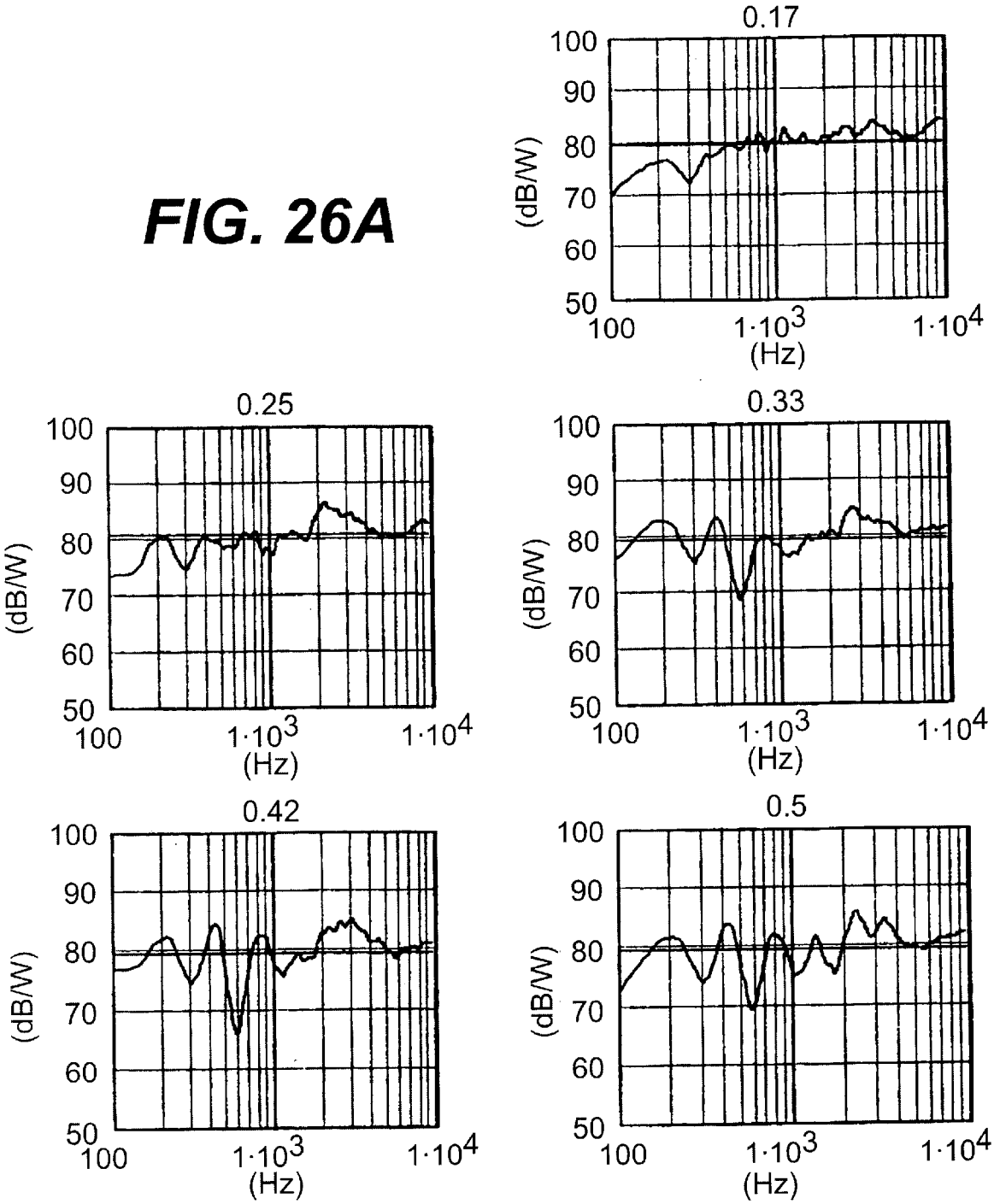
FIGS. 26A, B are output power/frequency graphs and power assessment bar chart for the intermediate stiffness panel member with seven point localised clamping assessed without normalisation.
Figure 26B:
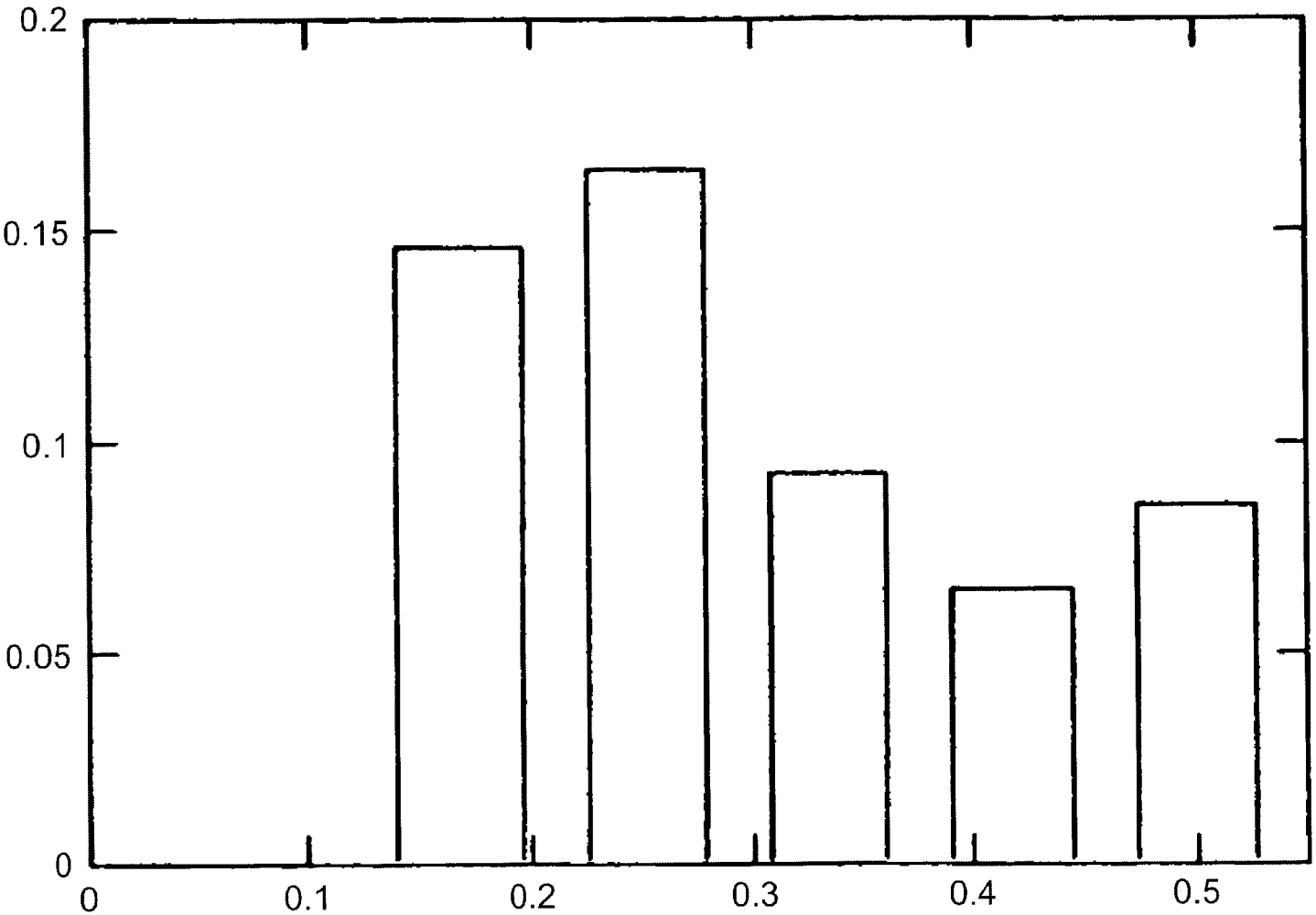
Figure 27A:
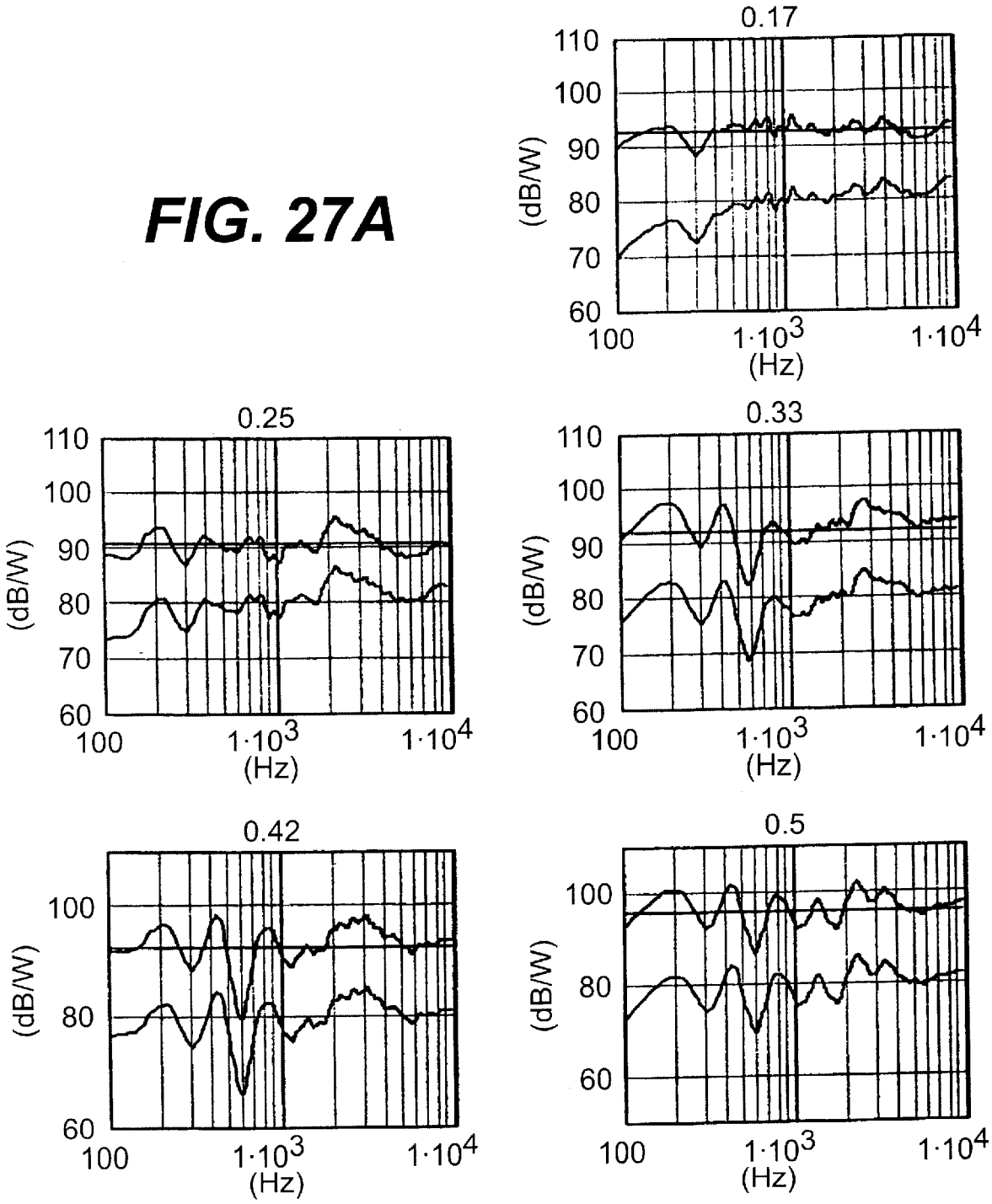
FIGS. 27A, B are similar but with normalising for power smoothness assessment.
Figure 27B:
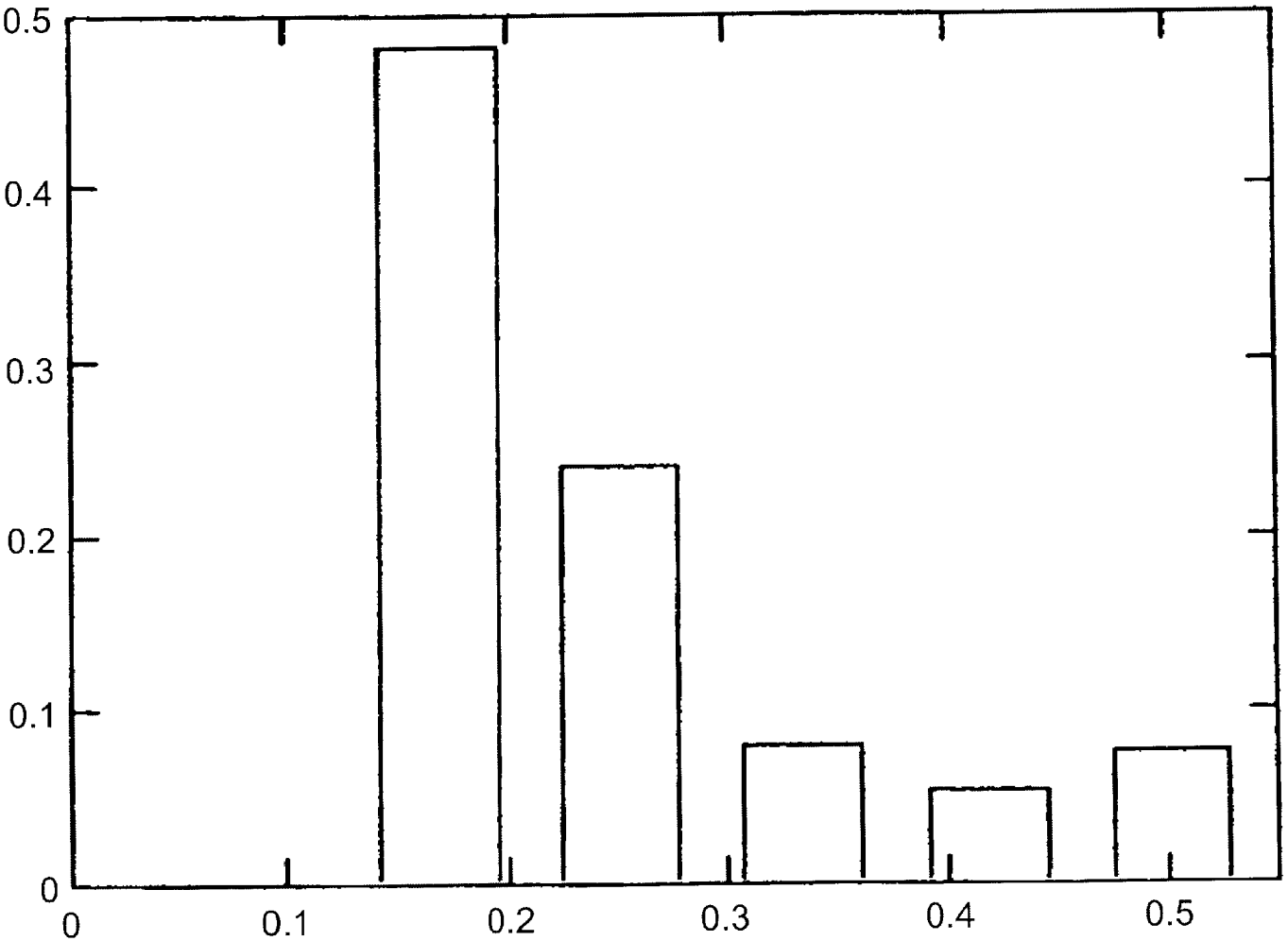
Figure 31A:
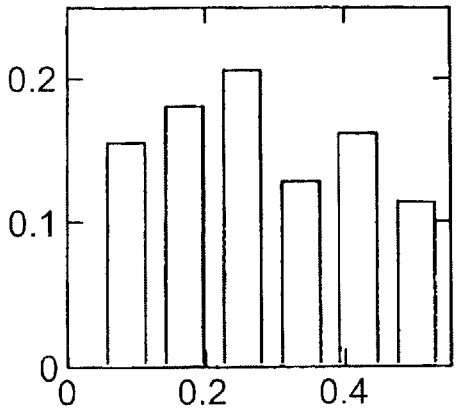
FIGS. 31A–E are power efficiency bar charts for the lower stiffness panel member for different edge conditions.

As far as single transducer edge or near-edge location is concerned, the other two tested panel members of much lower and intermediate stiffnesses also show the same in-board co-ordinate preference on a smoothness of power basis, see FIGS. 15 and 25. However, the lower stiffness panel member shows another band of nearly as promising locations ranging from about quarter to below tenth length from corners. Interestingly, if assessment is based on efficiency, i.e. amount of power output—as would be the case for a median line through the true output power plot being the basis used for mean square deviation—the above band becomes skewed to emphasise the quarter length position and is mostly preferential to the in-board coordinate related position, see inverse mean square deviation bar chart of FIG. 31A. The intermediate stiffness panel member veers towards the characteristic of the higher stiffness panel member in showing a promising spread between the in-board preferential coordinate positions, but also shows promise at about the one-tenth length positions.

It will be appreciated from inspection of true output power plots by those skilled in the art that there are differences between indicated best and viable transducer edge locations in terms of impact on expected quality of sound reproduction—for which modality is normally taken as a significant factor, i.e. number and even-ness of excitation of resonant modes. If characteristics such as modality are seen as more promising for locations indicated as preferential on the basis of assessing smoothness of output power, it is, of course, feasible to process input signals towards what is shown after above normalising—specifically selectively to amplify low frequency in a form of signal conditioning or equalising. This would achieve, indeed exceed, power available using locations optimised on efficiency basis; but obviously not the efficiency itself as more input power has to be used.

Figure 18A:
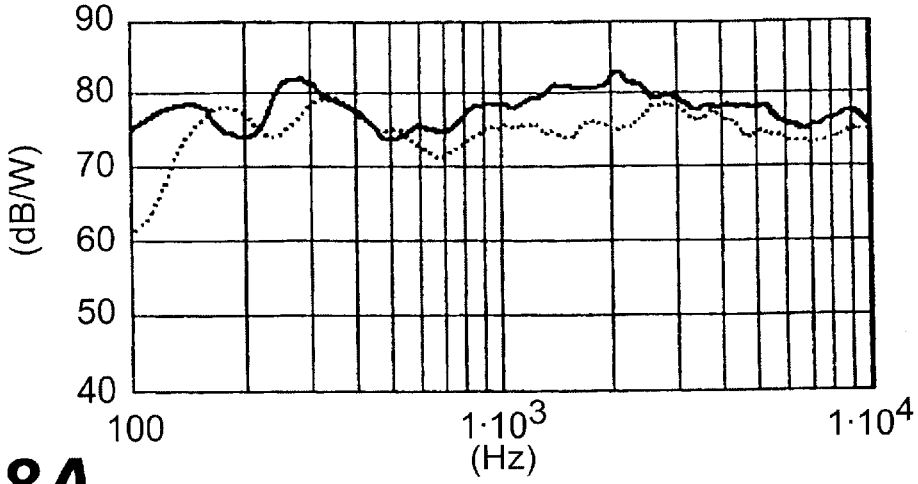
FIGS. 18A, B, C show effects of baffling, three-edge clamping and both.
Figure 18B:
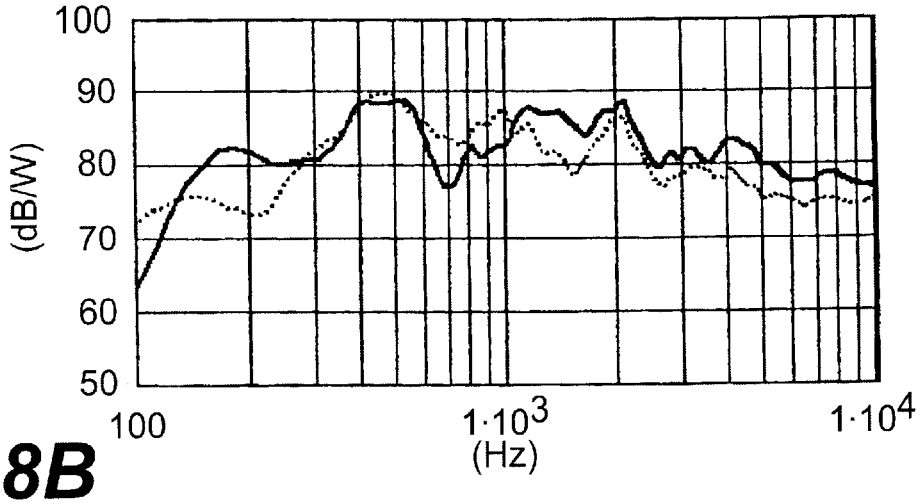
Figure 18C:
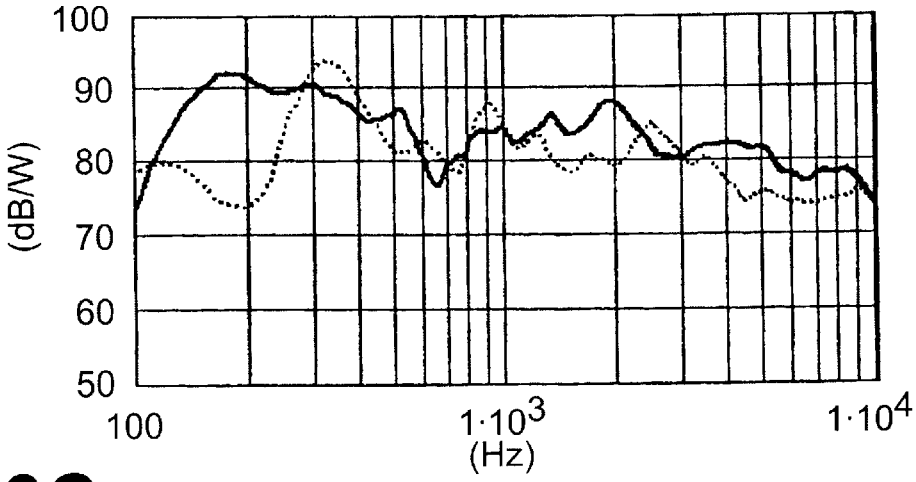
Figure 19A:
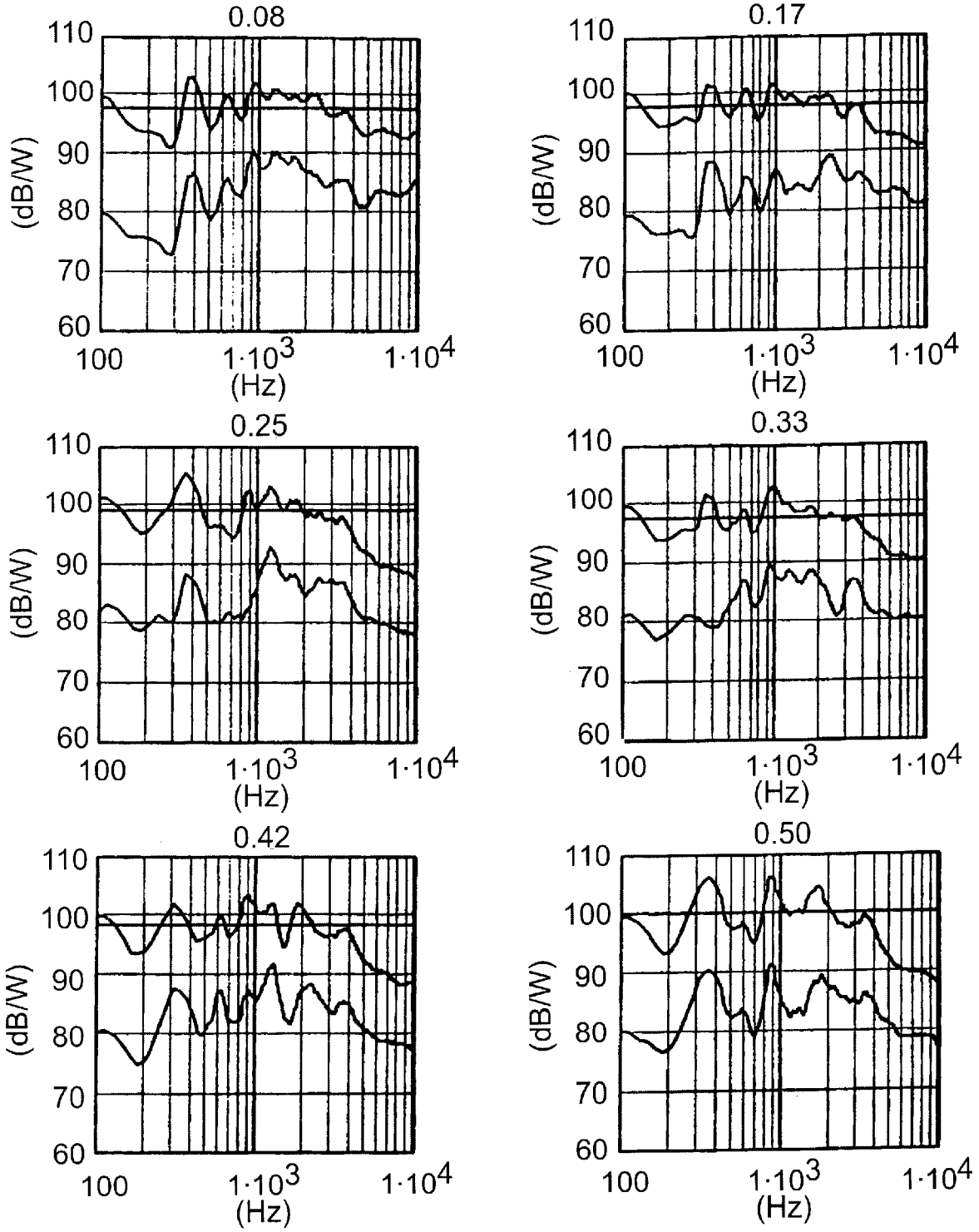
FIGS. 19A, B are output power/frequency graphs and related power smoothness bar chart for the low stiffness panel member clamped along on three edges and transducer positions on the fourth edge.
Figure 19B:
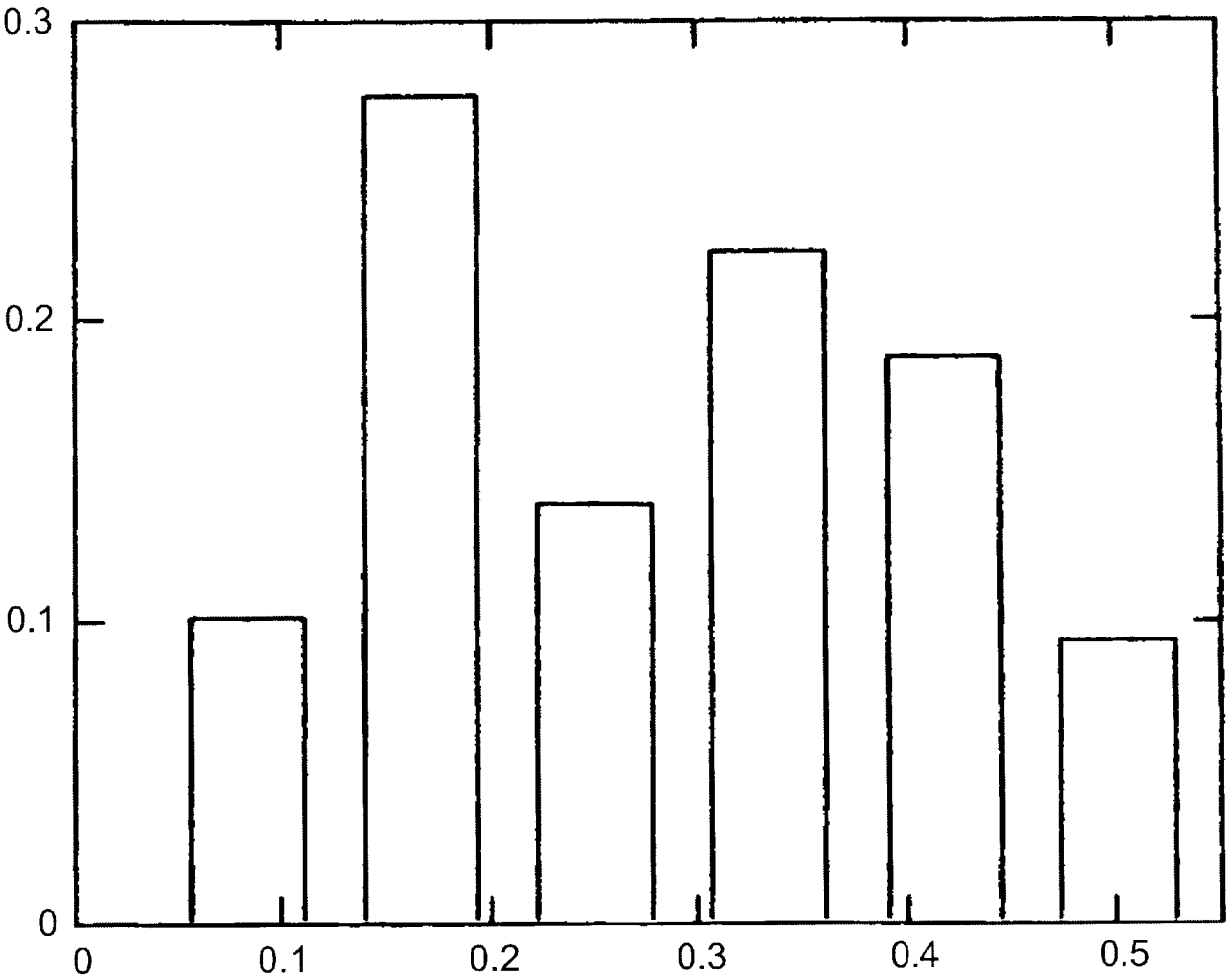
Figure 20A:
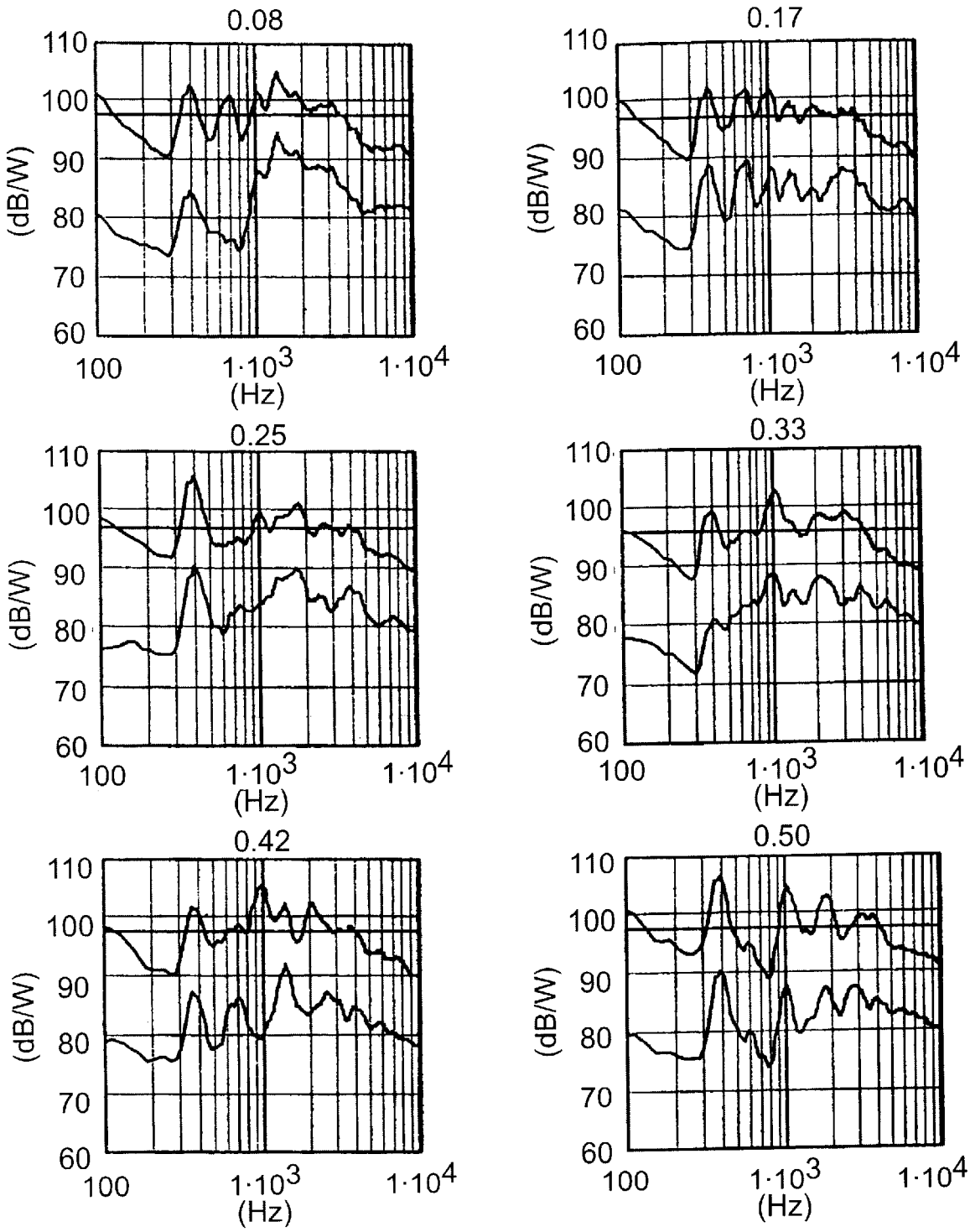
FIGS. 20A, B are output power/frequency graphs and related power smoothness bar chart for the low stiffness panel member clamped on two parallel edges sides and transducer positions on another edge.
Figure 20B:
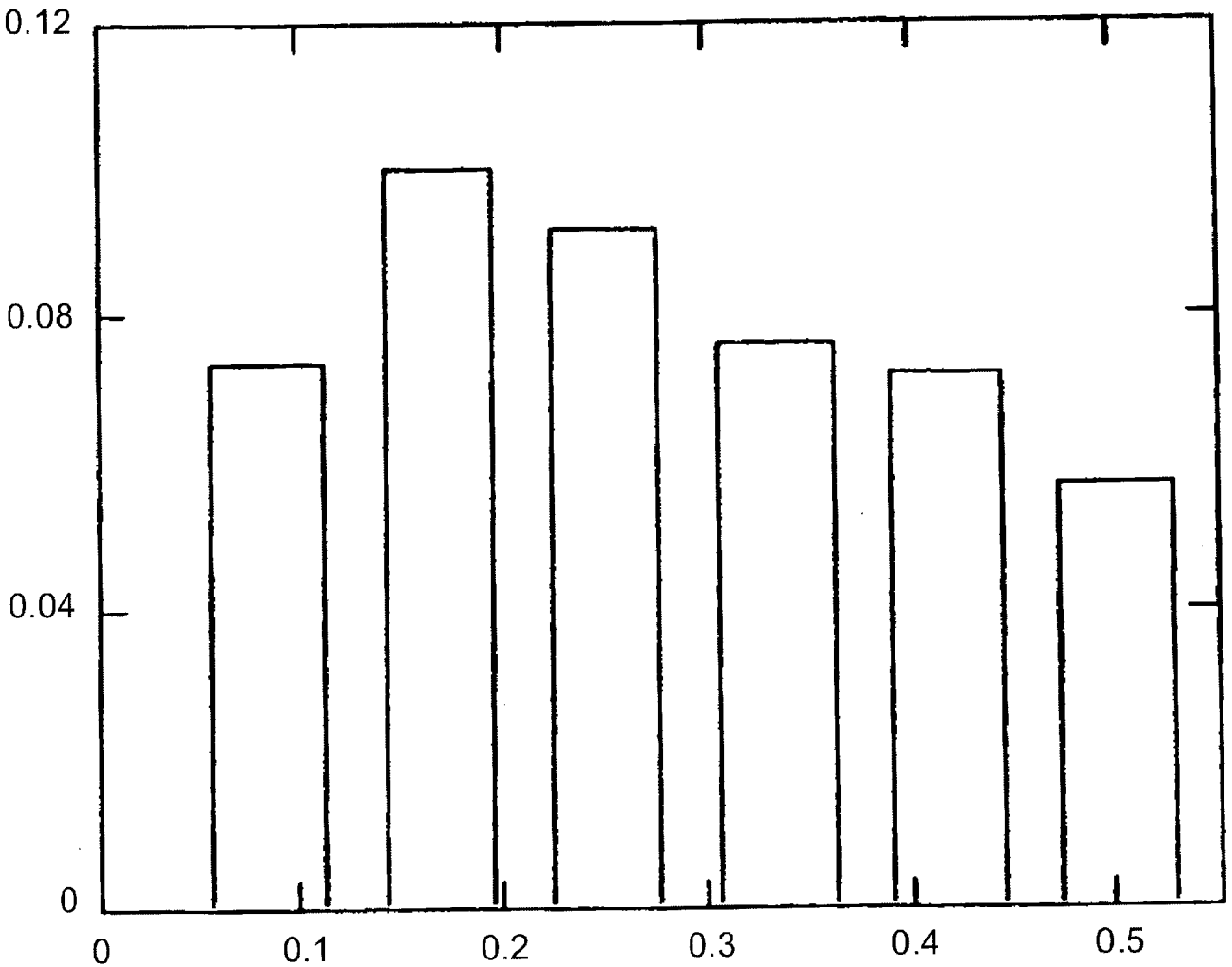
Figure 21A:
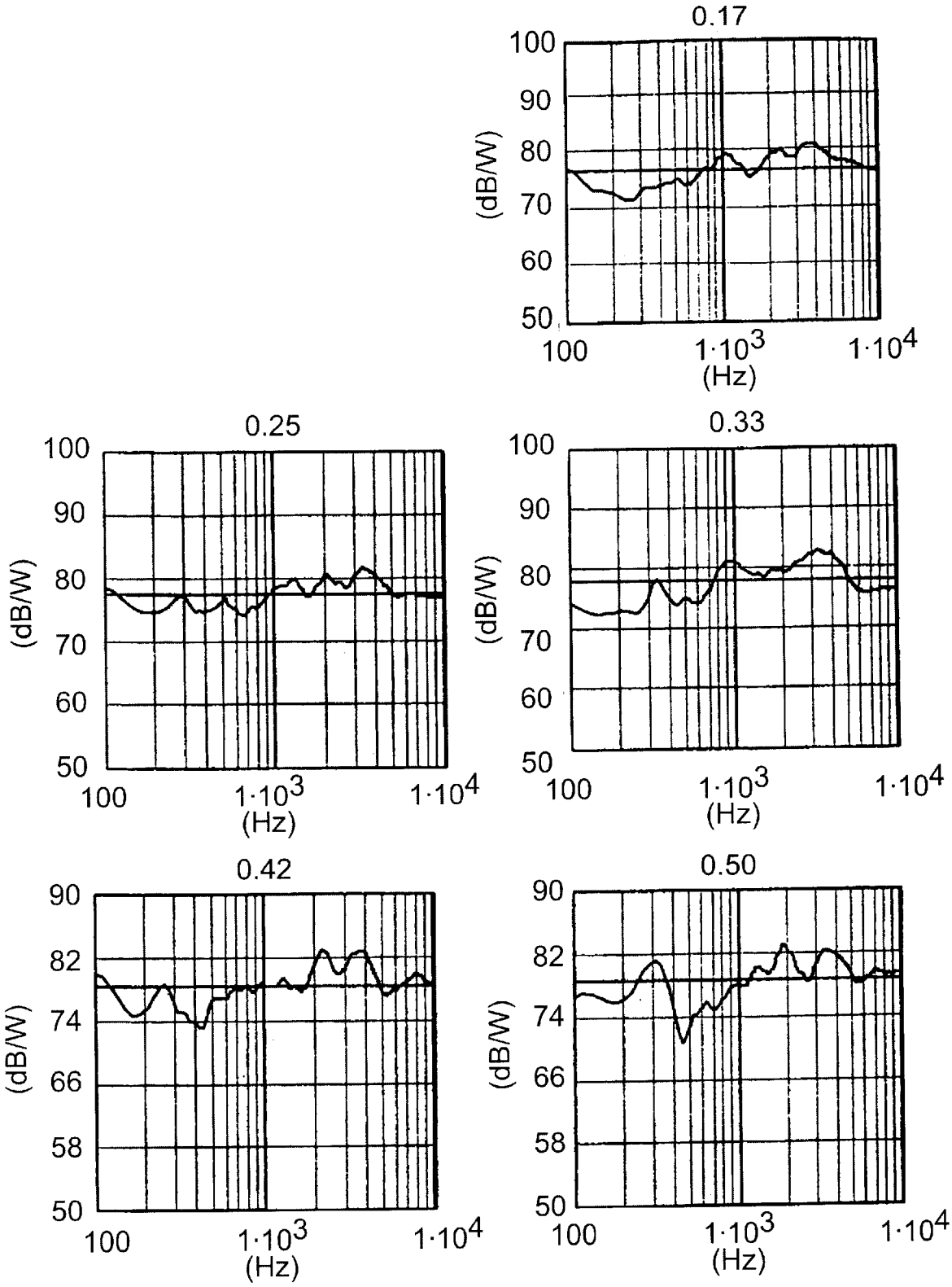
FIGS. 21A, B are output power/frequency graphs and related power smoothness bar chart for the low stiffness panel member with localised clamping at corners/mid-edges and transducer positions on other longer edge.
Figure 21B:
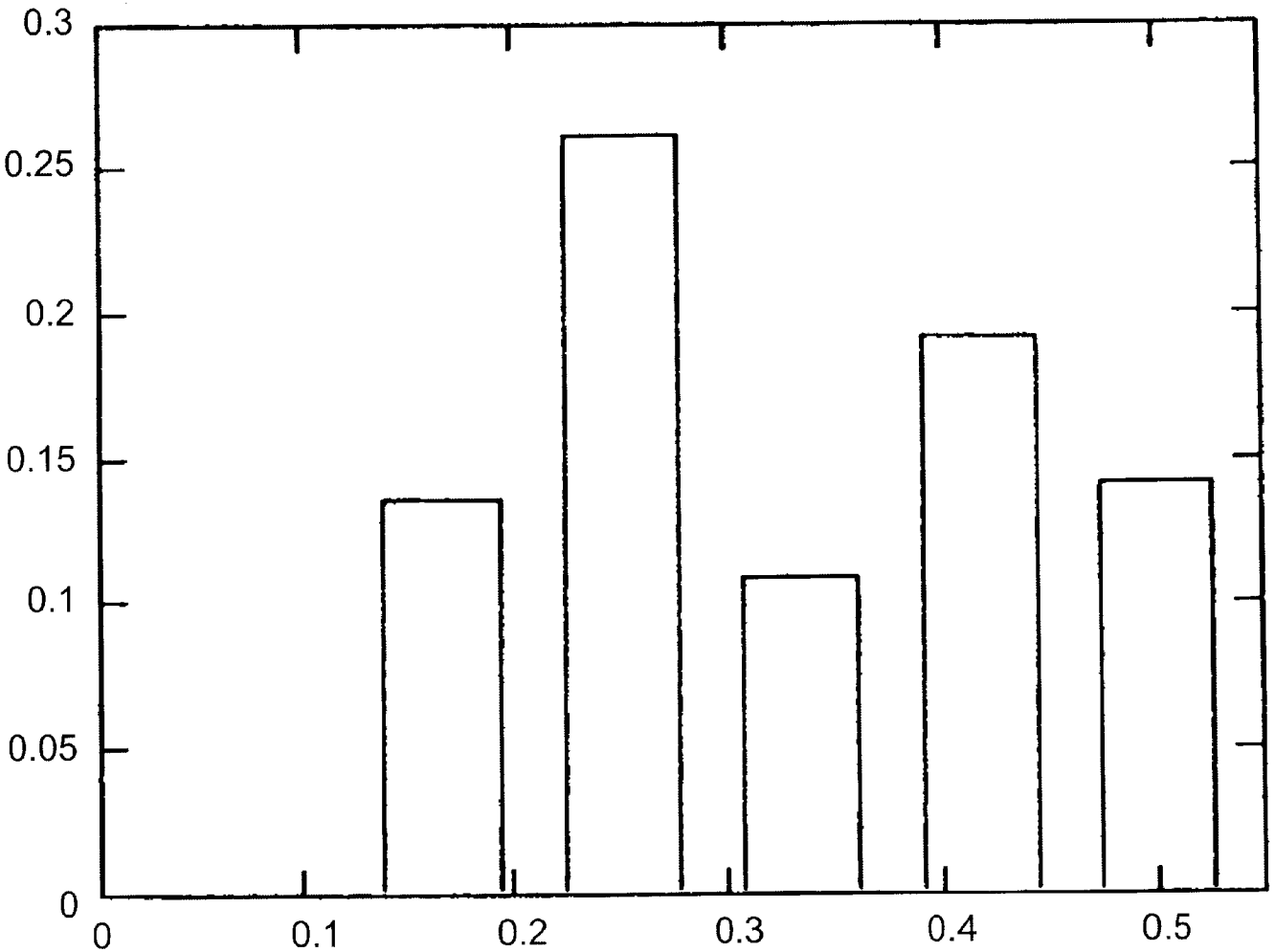
Figure 22:
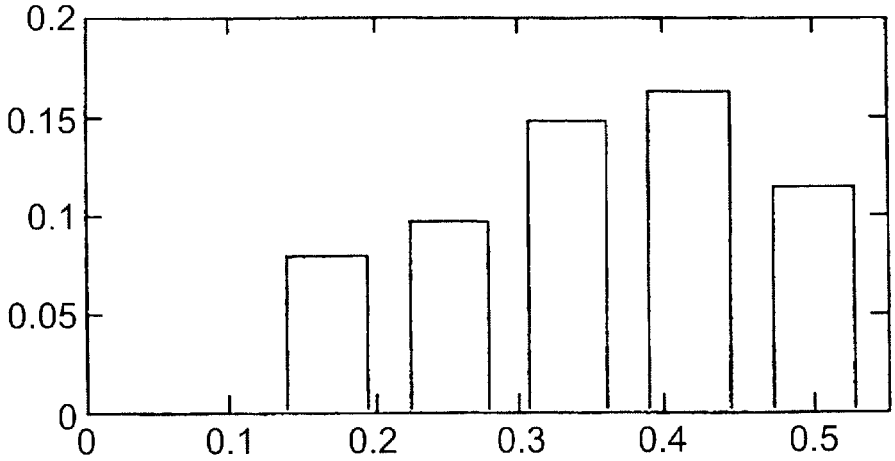
FIG. 22 is a power smoothness bar chart for the low stiffness panel member with further localised clamping between other corner/mid-point clamping.
Figure 29:
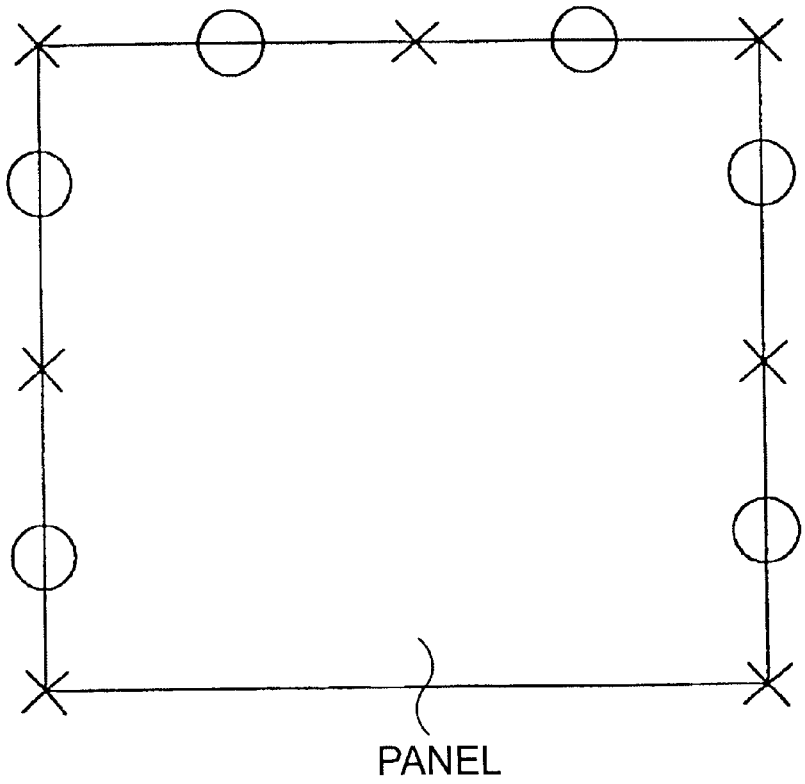
FIG. 29 indicates seven- and thirteen- point localised clamping as applied above.
Figure 31B:
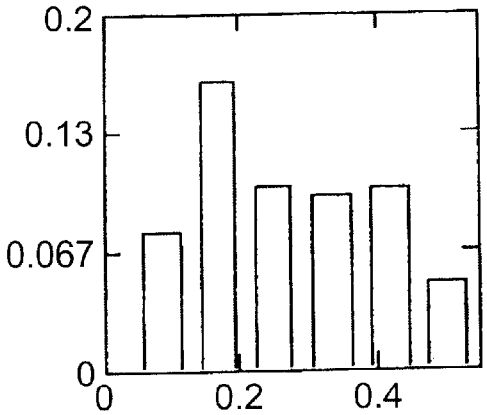
Figure 31C:
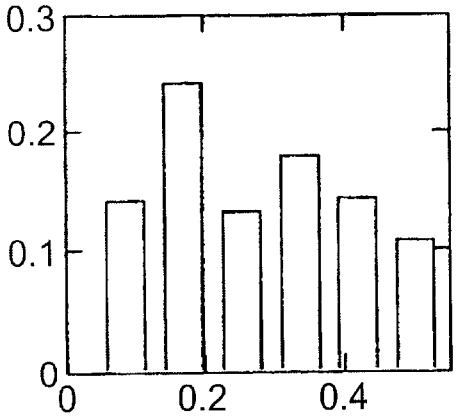
Figure 31D:
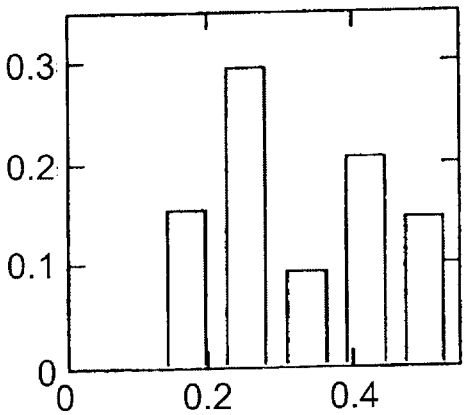
Figure 31E:
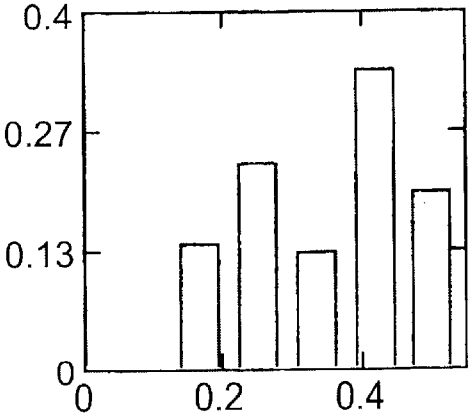

Accordingly, other ways of increasing lower frequency power were investigated as foreshadowed above, namely baffling and/or selectively spaced local clamping or full edge clamping. FIGS. 18A, B, C give indication of generally beneficial raising of lower frequency output for surrounding baffling with an area over 60% greater than the low stiffness panel, rigid clamping of all three edges not affording transducer location, and both of such baffling and clamping. Such baffling tends to maintain modality but may not always be feasible in specific applications. Accordingly, full investigation of clamping seemed worthwhile for alternative transducer edge locations for the lower stiffness panel member. Results showed that assessment on an efficiency basis tended to emphasise the quarter length point for both of full edge clamping at true parallel edges or three edges, and 7-point local edge clamping at corners and mid-points as at 'X' in FIG. 29, with the edge of transducer location unclamped along its length, see bar charts of FIGS. 31B, C and D, respectively. However, 13-point clamping as at 'X'+'O' in FIG. 29 shifted emphasis strongly to the in-board preferential coordinate position. Assessment of panel members with clamping on the basis of power smoothness produces much the same results for indication of best transducer locations, see bar charts of FIGS. 19A, 20B, 21B and 22, but with considerable differences as to next favoured positions, as is generally confirmed by inspection of true output power plots.

Indeed, particularly strong general correlation is found between preferences based on skilled inspection and assessment according to smoothness of power output. In turn, this tends to confirm at least slight preference for such assessment unless there are practical factors that lead to preference for efficiency rather than quality—though that may not be much different anyway.

Figure 23A:
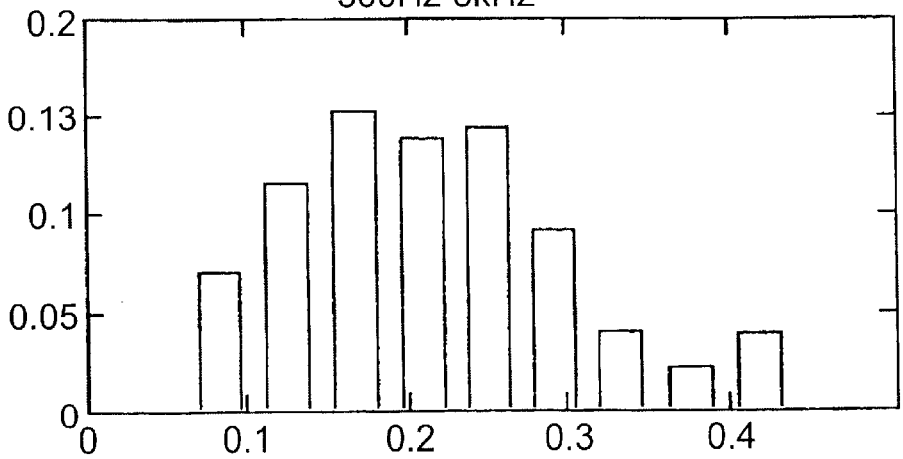
FIGS. 23A, B are bar charts for power assessment without normalisation for the low stiffness panel member with three edge clamping of seven-point and full edge nature, respectively, and for position of another local clamp along the other edge at which a transducer has an unfavourable position.
Figure 23B:
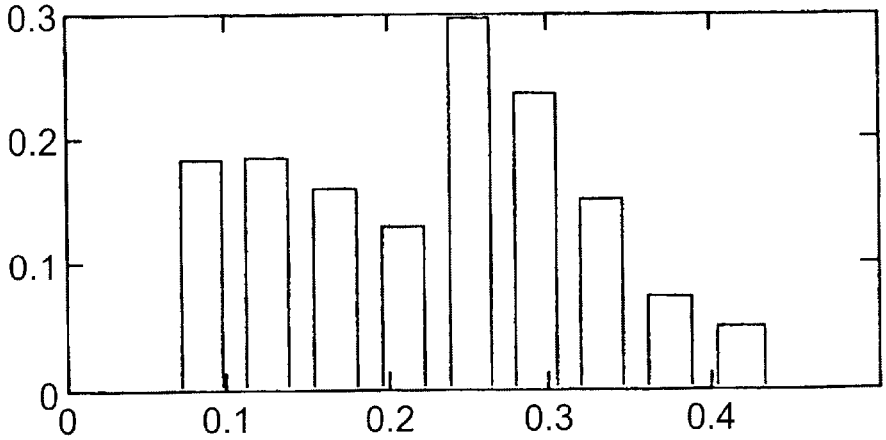
Figures 1, 24A:
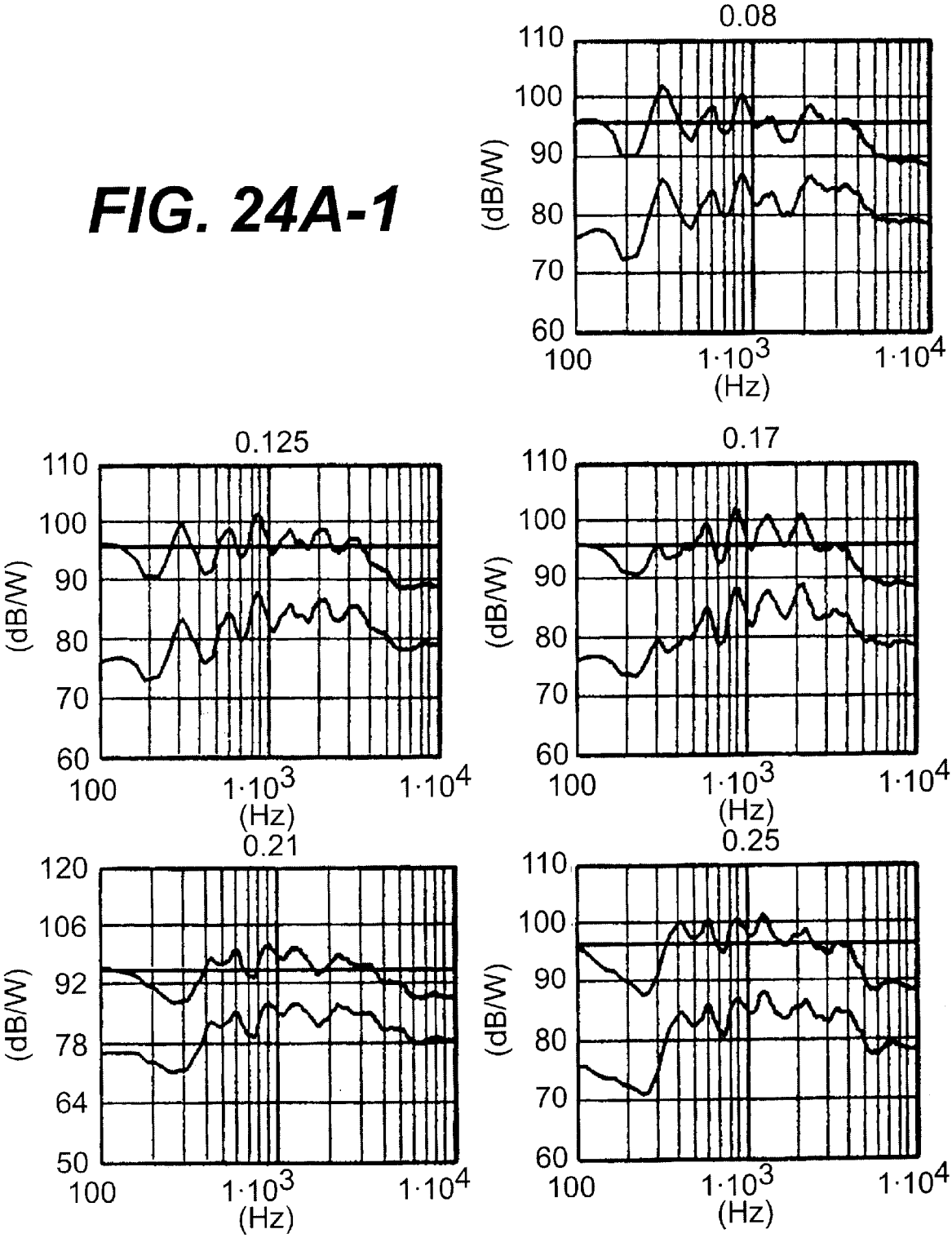
FIGS. 24A, B are power output/frequency graphs and related power smoothness bar chart for the three-edge clamped case assessed with normalisation.
Figures 2, 24A:
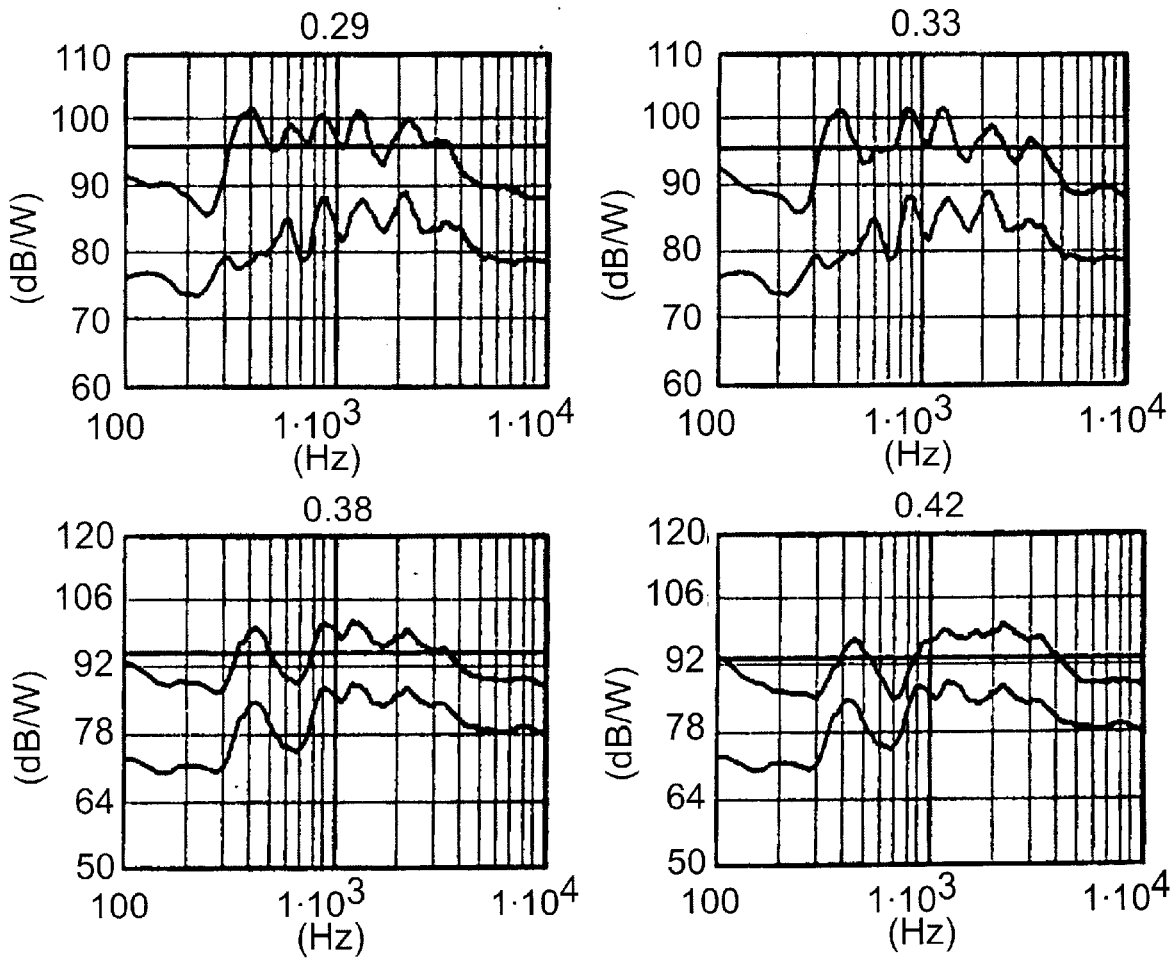
Figure 24B:
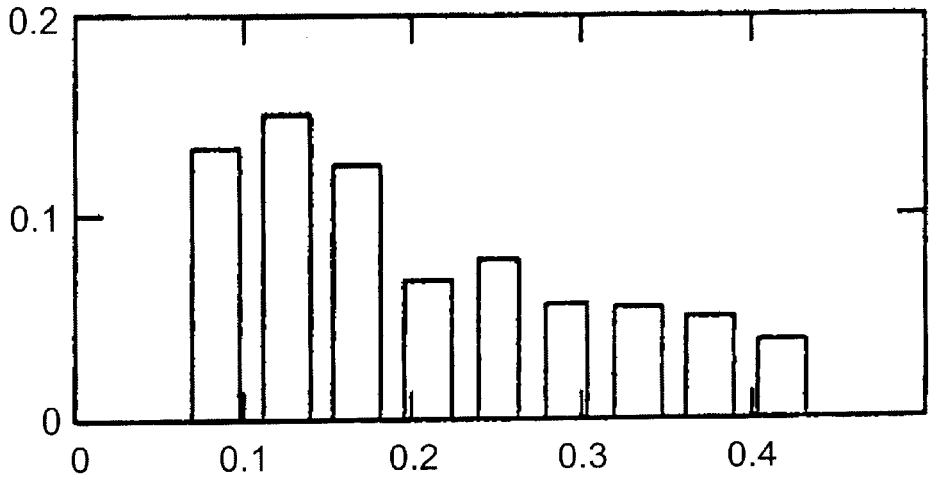

Another application for localised edge clamping is in relation to improving an unpromising transducer edge location, see bar charts FIGS. 23A, B showing right hand rather than left hand sides of the edge concerned as otherwise in the drawings. The cases concerned relate to the lower stiffness panel member, and are full clamping of three edges and seven point clamping, with a localised clamp varied along the same edge as the transducer. In both cases, useful improvement results at about the quarter length position from the corner more remote from the exciter—see reference bar at right hand side of FIG. 23B for no clamping condition. The spread is greater for the full edge clamping case, see FIG. 23A.

Where there is disagreement between assessments based on power efficiency and power smoothness, it is worth bearing in mind that any panel member with clamping of corners to the edge with which the transducer is associated effectively has forced nulls at the corner. There thus must be up to half wavelengths distance for resonant modes concerned before vibrational activity can reach anti-nodal peaks. If preference for a close-to-corner transducer location is indicated by power smoothness assessment, it should be treated with caution as it could be of low power/efficiency, even though smooth by reason of coupling to all resonant mode waveform concerned at may be quite small rises in their waveforms. Checking with the corresponding power/efficiency assessment is thus recommended. Indeed, best is always likely to be where there is substantial agreement between the two bases of assessment, or some compromise particularly suited to a specific application; and preferably further taking account of skilled inspection of power/frequency graphs perhaps advantageously with as well as without any normalisation for assessment purposes.

For the investigated panel members with higher and intermediate stiffnesses, there is a considerable measure of consistency as to best transducer edge locations, but with quite marked difference as to other promising locations. The much lower stiffness panel member is markedly less critical as to promising transducer edge locations.

This position is yet more apparent when considering use of more than one transducer associated with edges of the same panel member. The position for increased coupling to the resonant modes of a panel member is accompanied by complexity of their inevitable combined interaction with the natural distributed resonant vibration pattern of the panel member, and compounded by such distributed vibration pattern being available only at panel edges. There are notable variations from simple rules such as based on coordinates of established preferential in-board transducer location. However, the assessment procedures hereof afford valuable tools for finding good combinations of edge-associated transducer locations.

Figures 1, 13A:
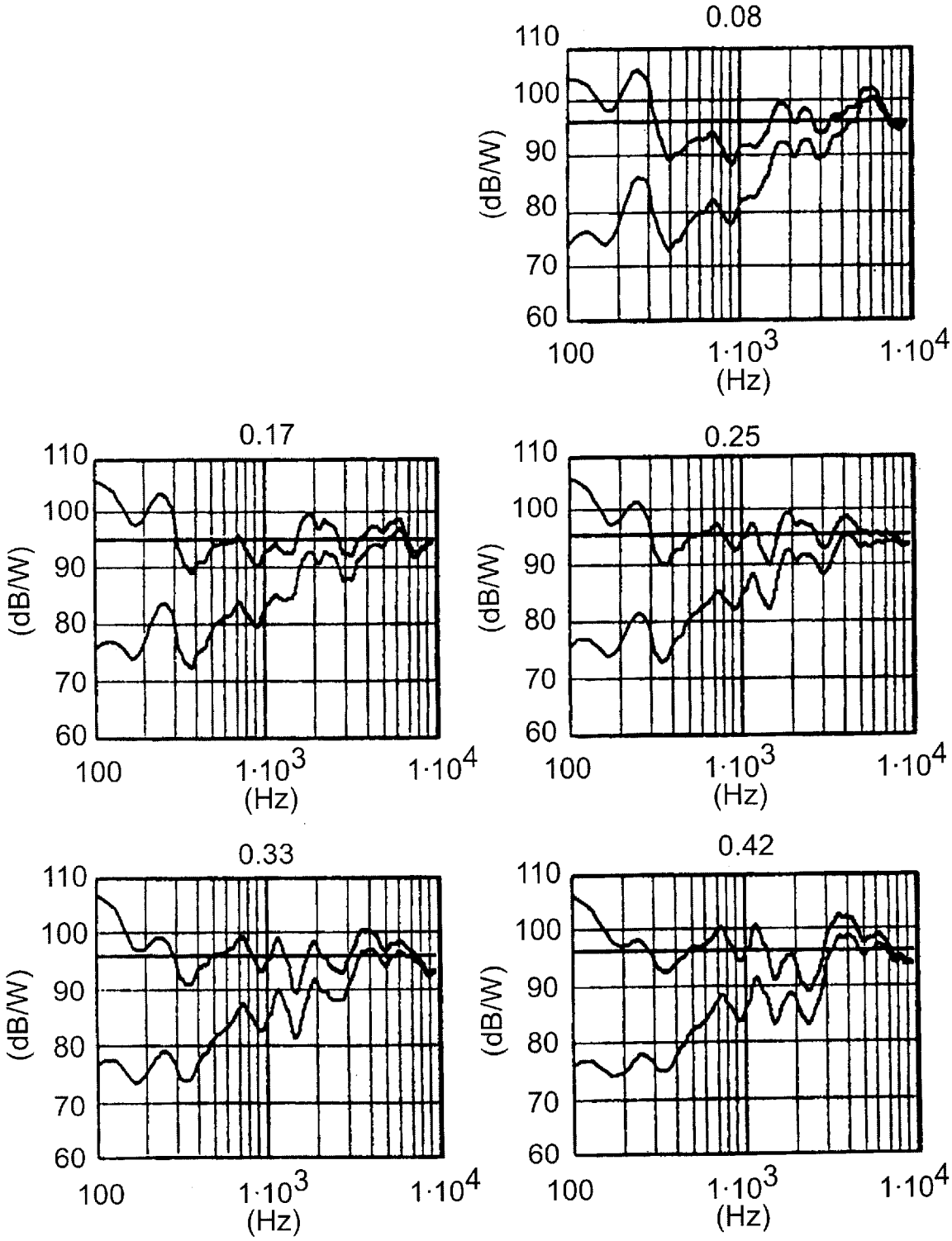
FIGS. 13A, B are graphs of output power/frequency for two transducer positions with one varied along shorter or longer edges.
Figures 2, 13A:
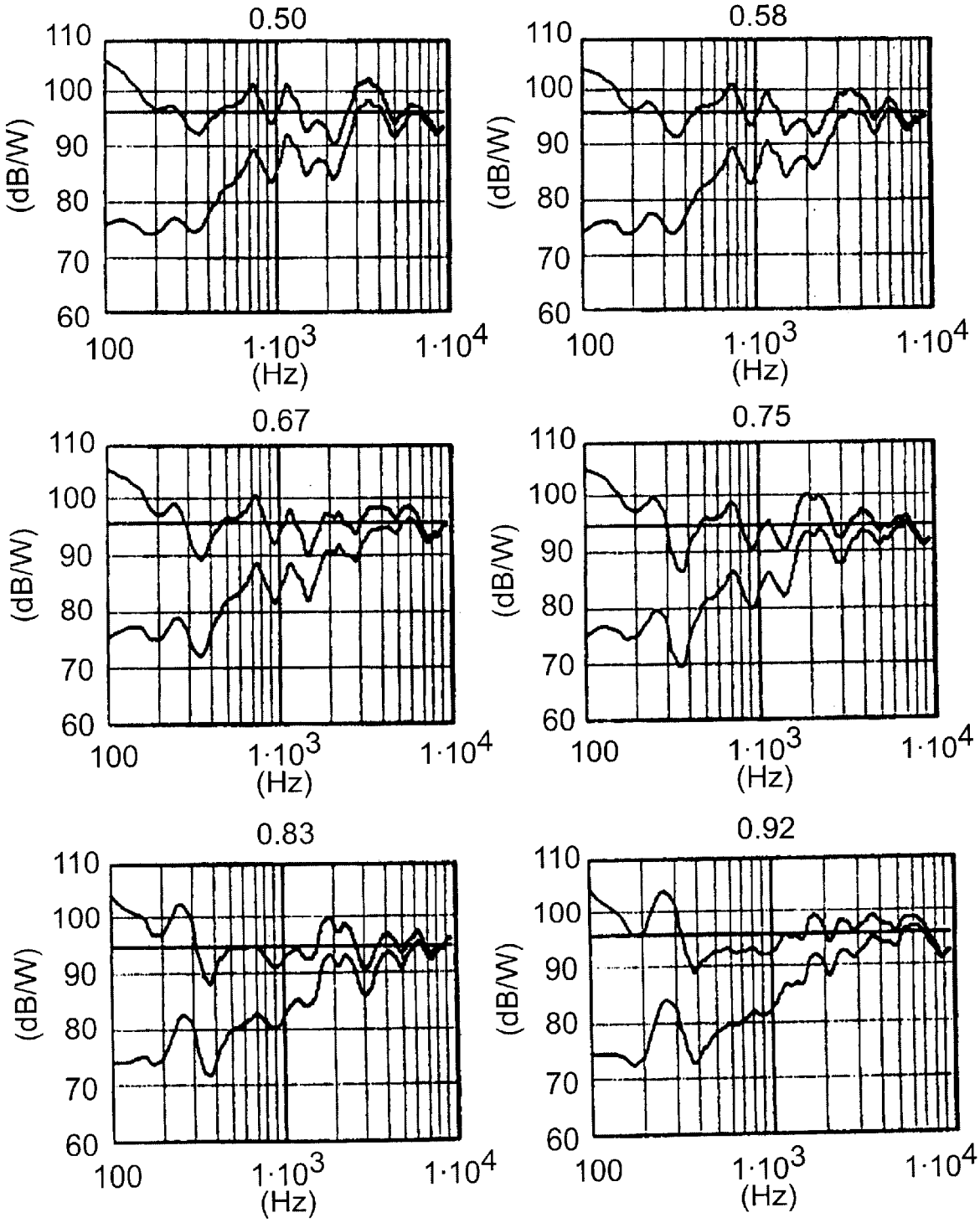
Figures 1, 13B:
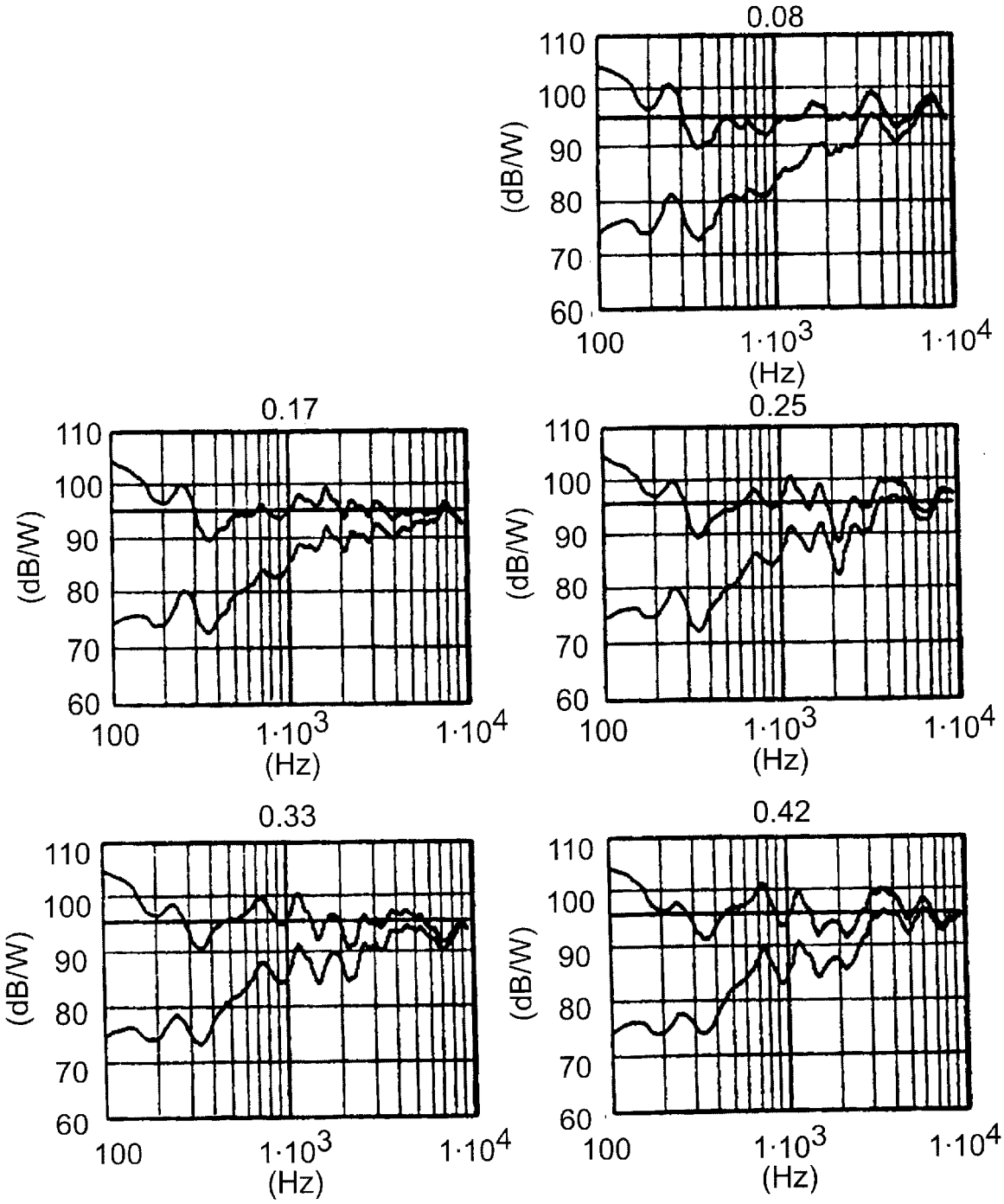
Figures 2, 13B:
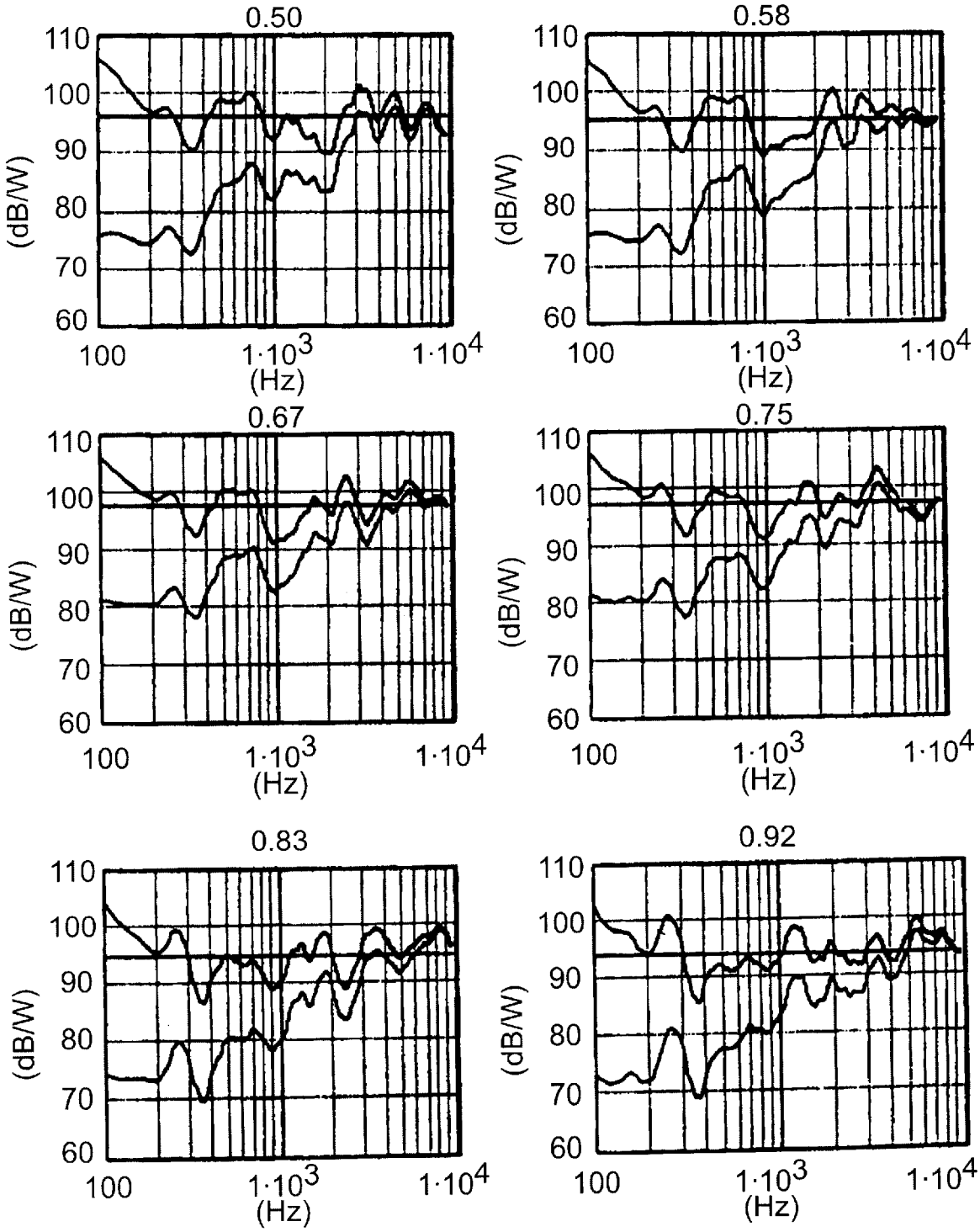
Figure 14A:
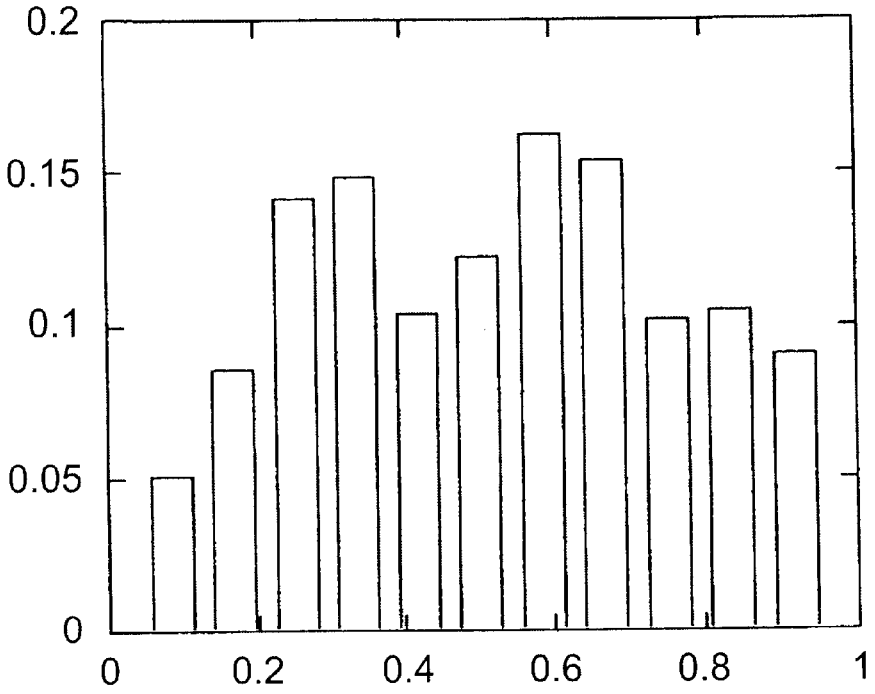
FIGS. 14A, B are related bar charts for measures of smoothness of output power.
Figure 14B:
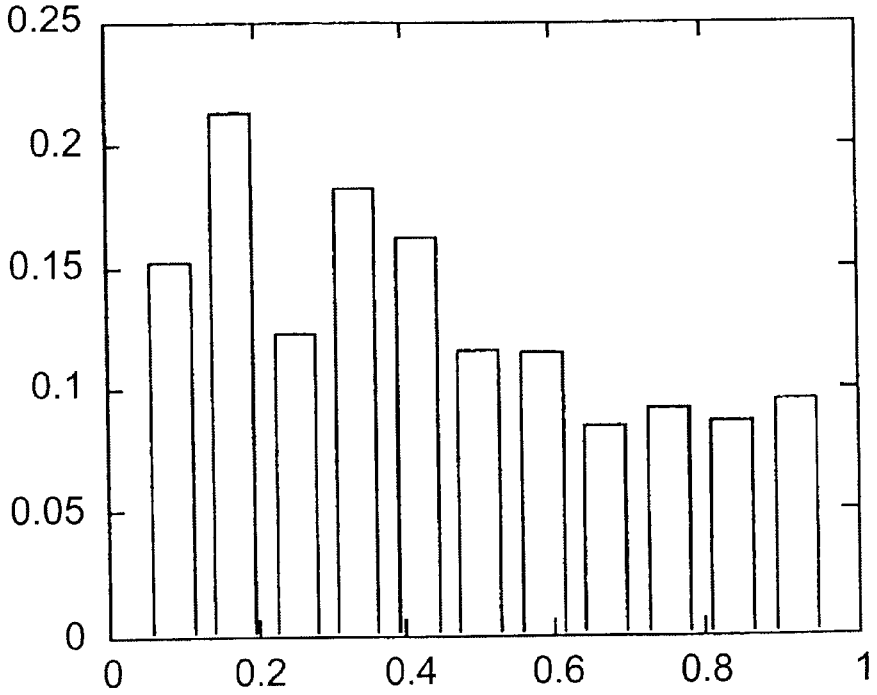

For the higher stiffness panel of the above Table, FIGS. 13A, 14A one transducer is located at a position within the tolerance range of about 0.38–0.45 for the 0.42 preferred position for a single transducer along the longer edge. A second transducer is varied along the closest shorter edge and FIG. 14A shows marginal preference for the furthest 0.42 preferred position, i.e. centred at 0.58, compared with several other positions at about quarter, third and two-thirds lengths from the common corner. Interestingly, fixing the second transducer at such about 0.58 preferred position along the shorter panel edge, and varying the other transducer along the longer pane edge (see FIGS. 13B, 14B), produced best and next best preferences at about the one-fifth (0.17) and quarter length positions along the longer panel edge, both showing better than the start position (about 0.42) for power smoothness. This is a procedure clearly capable of further application in an iterative manner, though it is recommended that either or both of power/efficiency assessment and skilled inspection be deployed, particularly if there is no convergence of location in the procedure or any indicated good position is less good in practice than hoped (or was before in the procedure).

Figures 1, 16A:
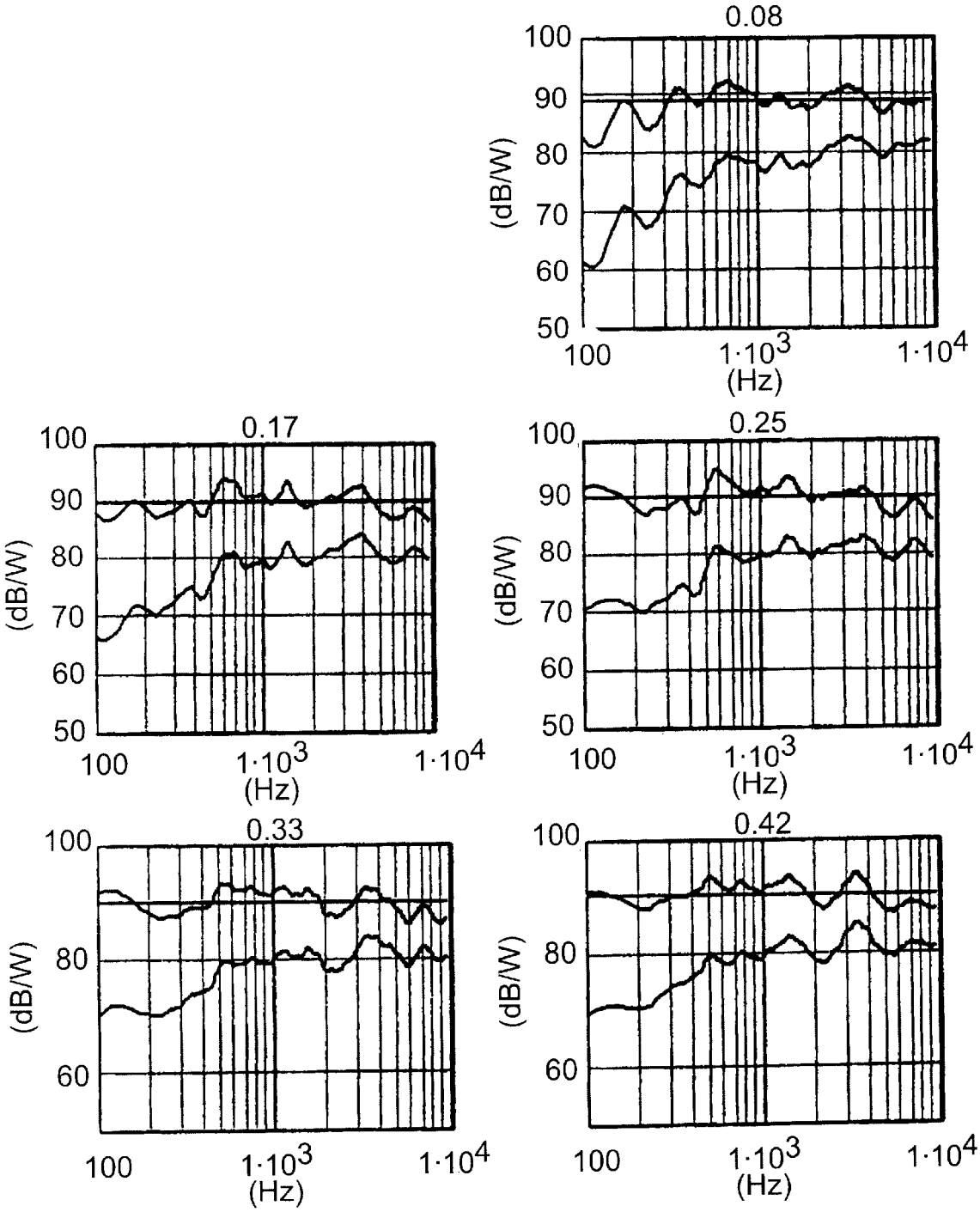
FIGS. 16A, B are output power/frequency graphs and power smoothness bar chart for second transducer positions along the shorter edge.
Figures 2, 16A:
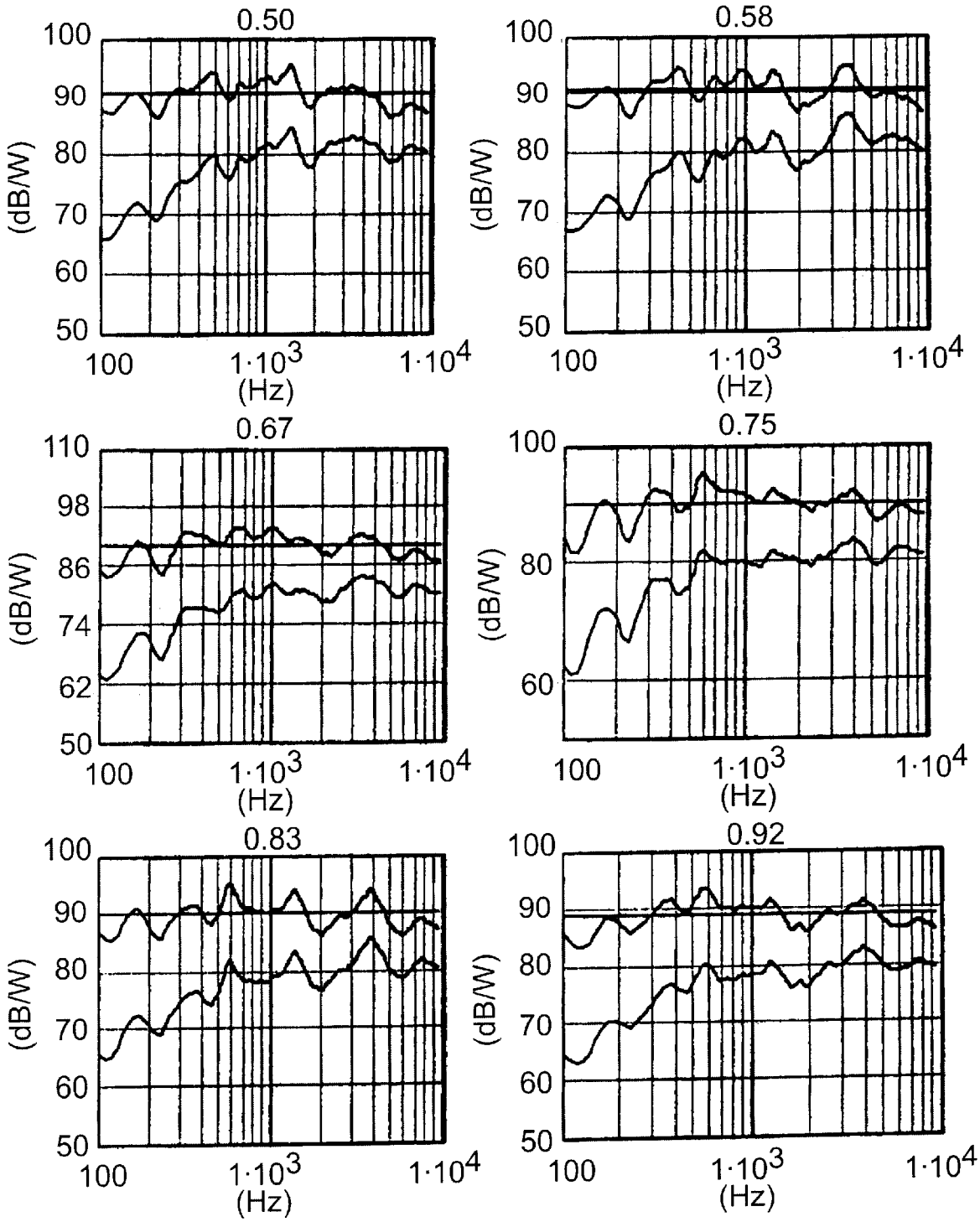
Figure 16B:
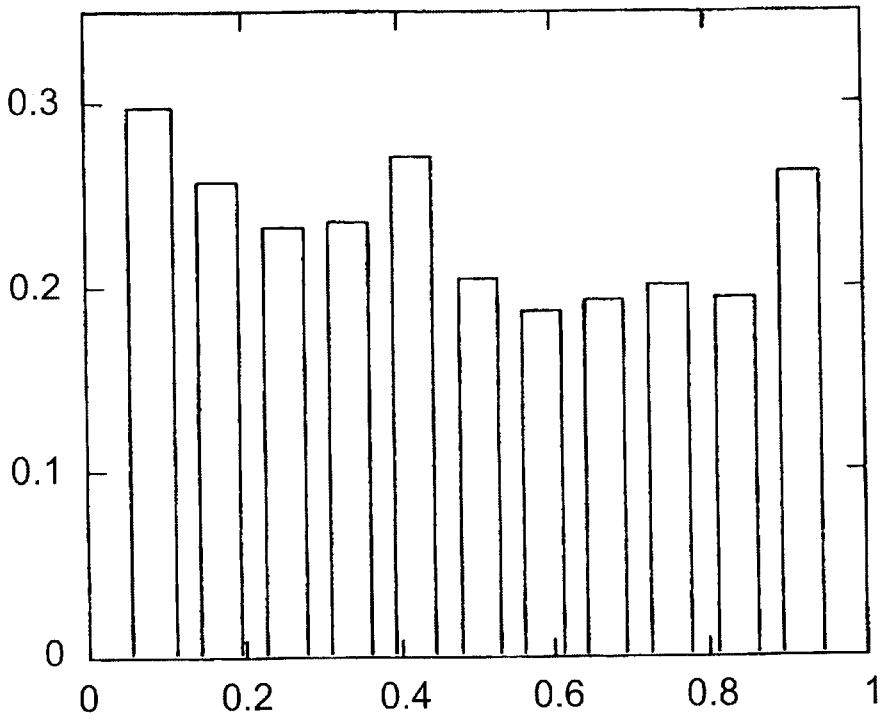
Figure 17:
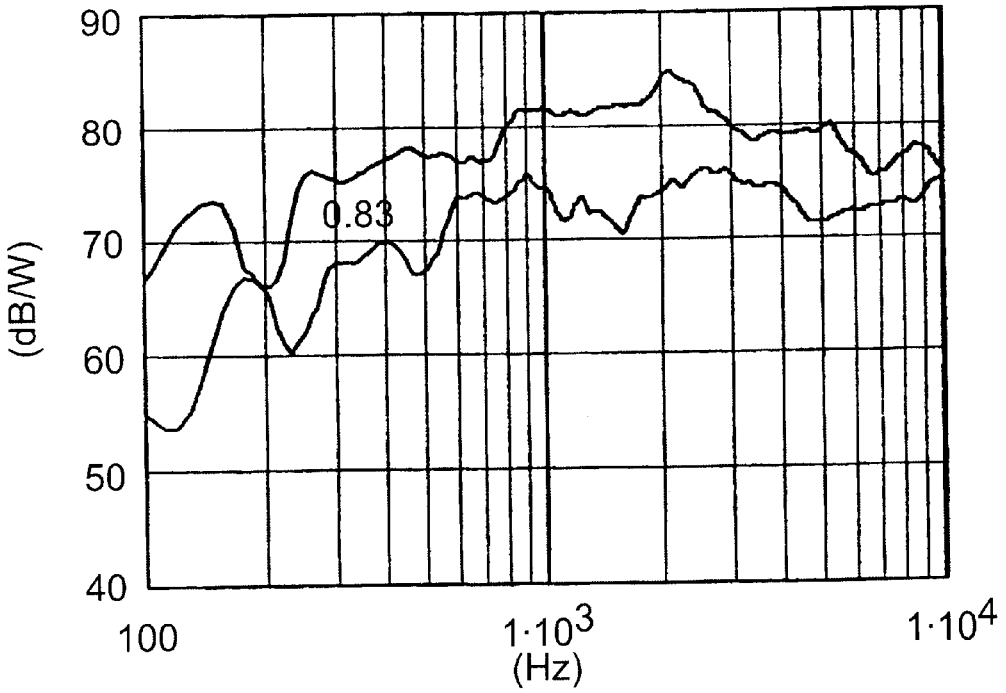
FIG. 17 shows comparison of power outputs with transducers located preferentially in-board and at edge for the low stiffness panel member.

FIGS. 16A, B show results of investigation of the much lower stiffness panel member with the preferred about 0.42 transducer location used for the longer edge and a second transducer varied along the nearest shorter edge. There were no great differences in power smoothness increase, the best three approaching corners and the nearest 0.42 preferential position, with some otherwise general preference for associations being in some quadrant.

Figures 1, 28A:
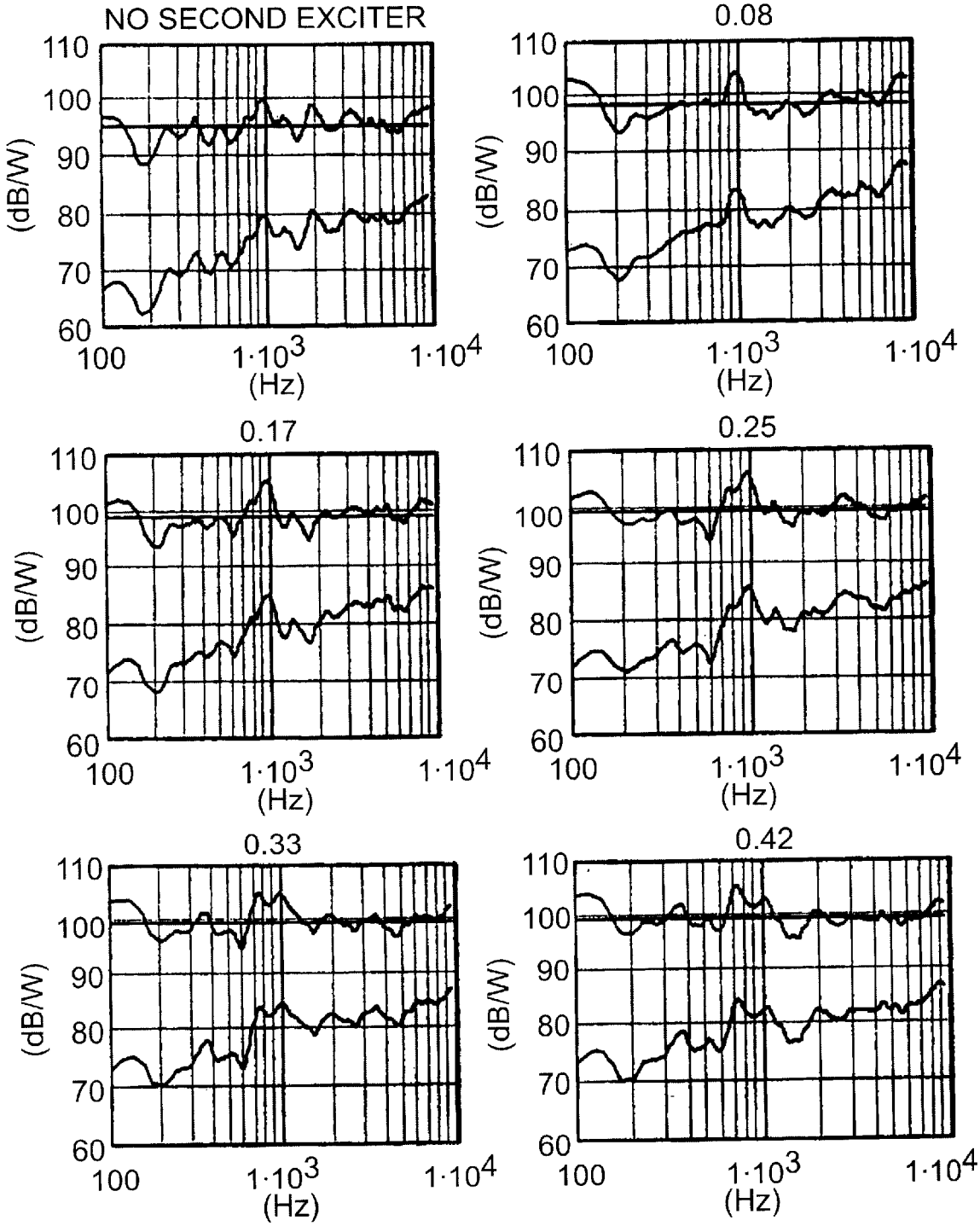
FIGS. 28A, B are power output graph and power smoothness bar chart for the intermediate stiffness panel member and a second transducer position along shorter edge.
Figures 2, 28A:
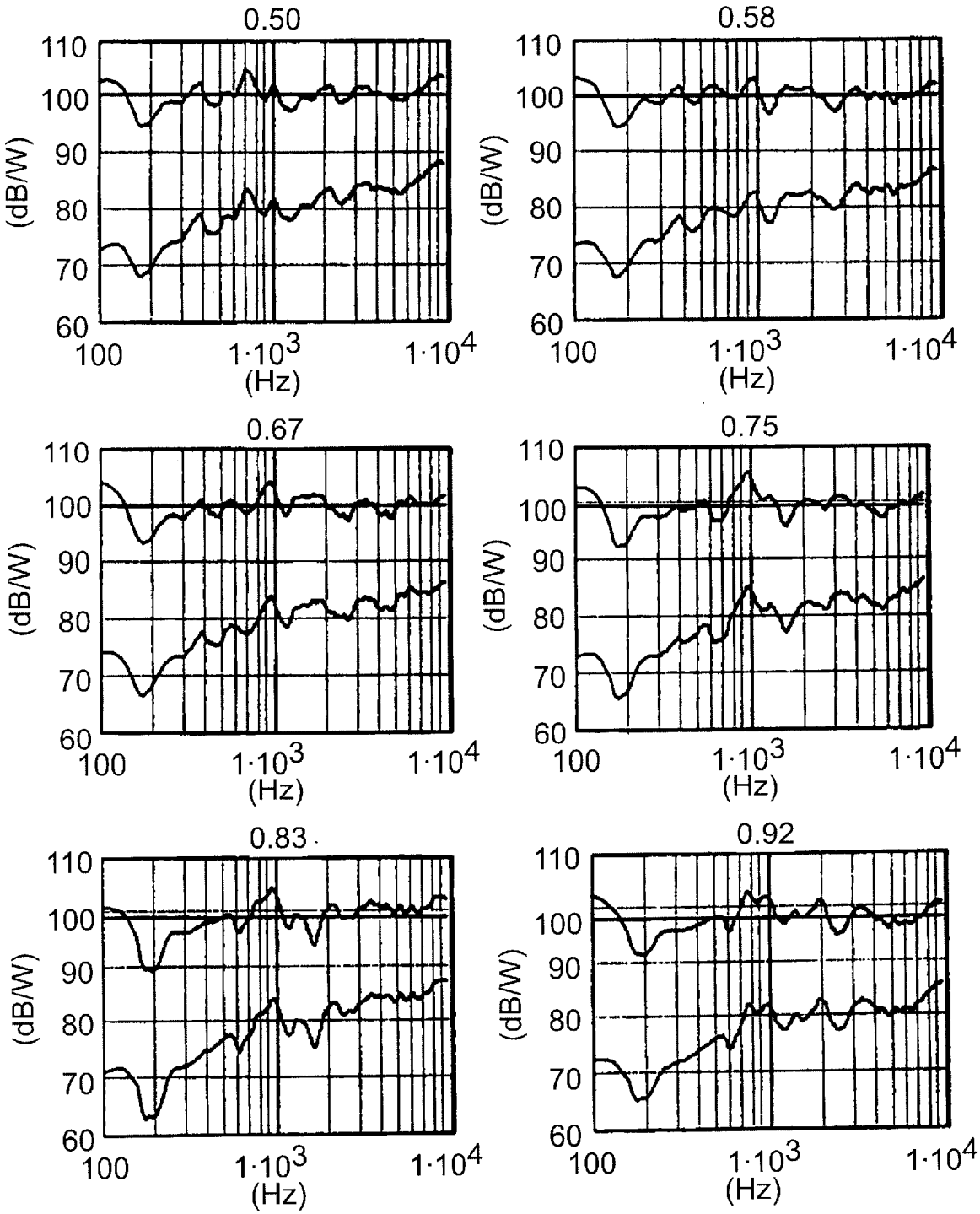
Figure 28B:
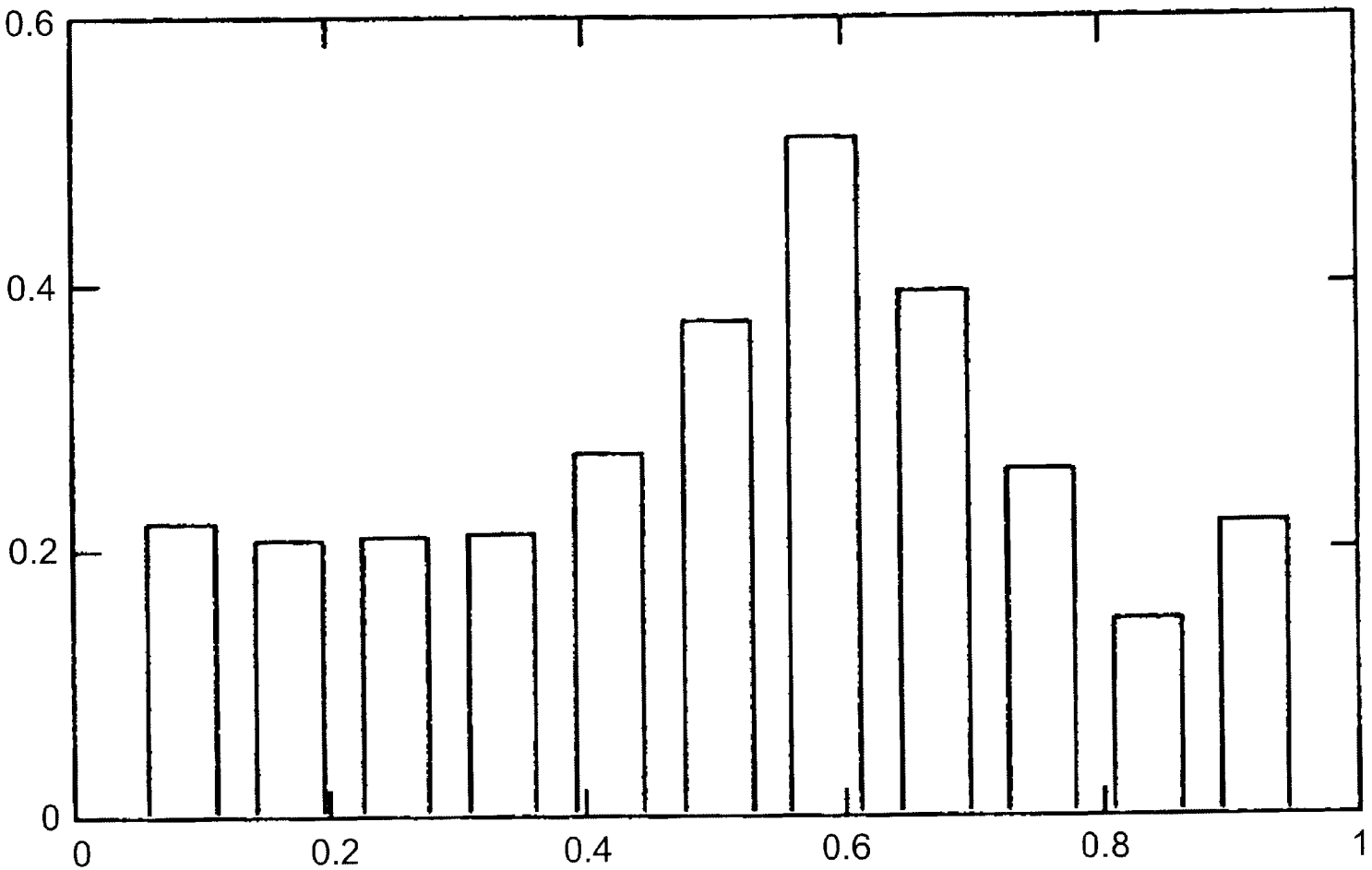

The same investigation for the intermediate stiffness panel member showed strong preference for the adjacent quadrant preferential 0.42 transducer location (actually 0.58), see FIGS. 28A, B.

Reverting to the case of the much less stiff panel member, two effects are seen as contributing to much less well-defined best/near best exciter position. One is that the panel modes for the range of frequencies of the optimisation are higher than for stiffer panel members. The panel member is therefore a closer approximation to a continuum, and smoothness of output power is less dependent on transducer position, particularly second transducer positions.

The other effect concerns the much lower mechanical impedance of the panel member, which leads to a less strong dependence on transducer position for energy transfer. The mechanism involved is now explained.

Figure 30:
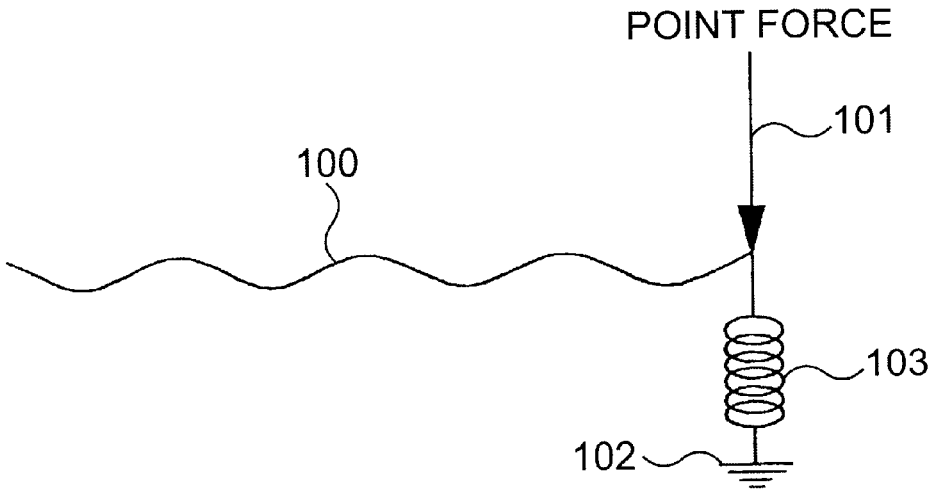
FIG. 30 is a schematic diagram useful in explaining impact of in-transducer compliance.

The mechanical impedance (Zm) of a panel member determines the movement resulting for an applied point force, see 100, 101 in FIG. 30. An object associated with the panel with a mechanical impedance put very much less than, even approaching comparable to, the panel impedance will strongly offset panel motion where the object is located. Associating an exciting transducer of moving coil type with the panel is equivalent to connecting the panel to a grounded mass (the magnet cup of the transducer, see 102) via a spring (the voice coil suspension of the transducer, see 108). When the impedance of such spring is too close to the panel impedance, it will in some part determine the panel motion at the transducer. In the limit of this spring wholly determining the point motion at the transducer, there would be no dependence of input power on exciter position. In practice the ratio of spring impedance to panel impedance can so profoundly affect best transducer location, and results are no longer so clear for best/near best transducer locations.

This low mechanical impedance has more effect for edge transducer location than for in-board transducer location as mechanical impedance is yet lower at the panel edge, which means that a transducer, voice coil suspension has a larger effect. Specifically, for the lower stiffness panel of the above Table:

mechanical impedance in the body of the panel is $$Zm_{body}=2.7\ \mathrm{Nsm}^{-1}$$

mechanical impedance at the panel edge is approximately half $Zm_{body}$, i.e.

$$Zm_{edge}=1.3\ \mathrm{Nsm}^{-1}$$

Compliance of the voice coil suspension of the transducer used is:

$$Cms=0.52\times10^{-3}\ \mathrm{mN}^{-1}$$

The mechanical impedance at each of modal frequencies can be an order of magnitude lower than the average impedance, $Zm_{edge}$. It is therefore feasible to estimate a typical frequency, below which the exciter has a strong effect on the panel member, say where impedance of the voice coil suspension is about one-fifth of the average impedance at the panel edge. Then, $$1/\omega\times Cms=\tfrac{1}{5}\times Zm_{edge}$$

and gives an estimate of 1200 Hz, below which the transducer and panel are intendedly coupled, which is within the frequency range of optimisation.

Considering the transducer and such low mechanical impedance, panel member as one coupled system the transducer in part determines the impedance of the panel member, and smoothness of the output power is less dependent on the position of the transducer.

Repeating such analysis for the high stiffness panel gives a corresponding frequency of 130 Hz, which is outside the frequency range of the optimisation.

What is claimed is:

1. A distributed mode active acoustic device comprising a plural-sided panel member and a transducer coupled to the panel member, the panel member being capable of sustaining bending waves in an operative frequency range over an active area of the transverse extent of the panel member with a distribution of resonant modes of bending wave vibration determining acoustic performance in conjunction with the transducer, the panel member having at least one in-board region of said active area where a plurality of lower frequency resonant bending wave modes in the operative frequency range have vibrationally active anti-nodes, the transducer being coupled to the panel member at a marginal position of the panel member for beneficial operative interaction of the transducer with the panel member so as to leave said at least one in-board region substantially unobstructed, said marginal position corresponding to an orthogonal coordinate of said at least one in-board region.

2. A distributed mode active acoustic device according to claim 1, wherein said panel member is clamped along at least a portion of its edge.

3. A distributed mode active acoustic device according to claim 2, wherein said edge clamping is localised.

4. A distributed mode active acoustic device according to claim 3, having plural said localised edge clamping.

5. A distributed mode active acoustic device according to claim 4, wherein mutual spacing of said plural localised edge clamping is related to wavelengths of lower frequency resonant modes so as to raise their contribution to acoustic action of the device.

6. A distributed mode active acoustic device according to claim 2, wherein said plural localised edge clamping is associated with more than one side.

7. A distributed mode active acoustic device according to claim 6, wherein said panel member is substantially rectangular and said plural localised edge clamping is associated with three sides not associated with said transducer means.

8. A distributed mode active acoustic device according to claim 7, wherein said plural localised edge clamping is at each corner and at mid-points of said three sides.

9. A distributed mode active acoustic device according to claim 2, wherein said edge clamping extends along said panel member.

10. A distributed mode active acoustic device according to claim 9, wherein said edge clamping extends along at least one side not associated with said transducer means.

11. A distributed mode active acoustic device according to claim 10, wherein said panel member is substantially rectangular and said edge clamping extends along two parallel sides.

12. A distributed mode active acoustic device according to claim 10, wherein said edge-clamping extends along three sides.

13. A distributed mode active acoustic device according to claim 1, claim 10 or claim 18, wherein the panel member is generally rectangular, and said marginal position is within about 10% and 15% in the mid-regions of shorter and longer edges of the panel member, respectively.

14. A distributed mode active acoustic device according to claim 1, claim 10 or claim 18, wherein the panel member is generally rectangular, and said marginal position is within about 28% and 30% at quarter-length positions of the panel member, respectively.

15. A distributed mode active acoustic device according to claim 1, claim 10 or claim 18, wherein the panel member is generally rectangular, and said marginal position lies in the range of about 0.38 to 0.45 length from any corner of the panel member.

16. A distributed mode active acoustic device according to claim 15, wherein said marginal position is at about 0.42 to 0.44 length from any corner of the panel member.

17. A distributed mode active acoustic device according to claim 1, wherein said panel member has at least two said transducers in edge association therewith.

18. A distributed mode active acoustic device according to claim 17, wherein said panel member is of plural sided form with said transducers associated with at least two side edges.

19. A distributed mode active acoustic device according to claim 17 or claim 18, wherein said panel member is substantially rectangular with said transducers associated with longer and shorter sides thereof.

20. A distributed mode active acoustic device comprising a plural sided panel member and a transducer coupled thereto, the panel member being capable of sustaining bending waves with a distribution of resonant modes of bending wave vibration determining acoustic performance in conjunction with the transducer, wherein the transducer is located at a marginal position of the panel member not itself selected for best operative interaction with said panel member so as to leave the panel member substantially unobstructed, and wherein mass is coupled to the edge of the panel member at at least one discrete location chosen to improve acoustic operation of the device in conjunction with the transducer.

21. A distributed mode active acoustic device comprising a plural sided panel member and a transducer coupled thereto, the panel member being capable of sustaining bending waves with a distribution of resonant modes of bending wave vibration determining acoustic performance in conjunction with the transducer, wherein the transducer is located at a marginal position of the panel member not itself selected for best operative interaction with the panel member so as to leave the panel member substantially unobstructed, and wherein the edge of the panel member is clamped at at least one discrete location chosen to improve acoustic operation of the device in conjunction with the transducer.

22. A distributed mode active acoustic device according to claim 1, claim 20 or claim 21, further comprising baffling extending about and beyond said panel member.

23. A distributed mode active acoustic device according to claim 1, claim 20 or claim 21, wherein said panel member is at least partially transparent or translucent.

24. A distributed mode active acoustic device according to claim 1, claim 20 or claim 21, wherein said transducer is of electro-mechanical type.

25. A distributed mode active acoustic device according to claim 1, claim 20 or claim 21, wherein said transducer is operative to launch compression waves into the edge of said panel member and/or to deflect the edge of said panel member laterally to launch transverse bending waves along said panel member and/or to apply torsion across a corner of said panel member and/or to produce linear deflection of a local edge region of said panel member.

26. Method of improving the acoustic operation of a distributed mode active acoustic device comprising a plural sided panel member and a transducer coupled thereto, the panel member being capable of sustaining bending waves with a distribution of resonant modes of bending wave vibration determining acoustic performance in conjunction with the transducer, the transducer being located at a marginal position of the panel member not itself selected for best operative interaction with said panel member so as to leave the panel member substantially unobstructed; the method comprising coupling mass to the edge of the panel member at a discrete location chosen to improve acoustic operation of the device in conjunction with the transducer.

27. Method of improving the acoustic operation of a distributed mode active acoustic device comprising a plural sided panel member and a transducer coupled thereto, the panel member being capable of sustaining bending waves with a distribution of resonant modes of bending wave vibration determining acoustic performance in conjunction with the transducer, the transducer being located at a marginal position of the panel member not itself selected for best operative interaction with said panel member so as to leave the panel member substantially unobstructed; the method comprising clamping the edge of the panel member at a discrete location chosen to improve acoustic operation of the device in conjunction with the transducer.

* * * * *